United States Patent [19]

Takada et al.

[11] Patent Number: 4,734,358

[45] Date of Patent: Mar. 29, 1988

[54] SILVER HALIDE PHOTOGRAPHIC LIGHT-SENSITIVE MATERIAL

[75] Inventors: Shun Takada; Masanobu Miyoshi; Kaoru Onodera, all of Odawara, Japan

[73] Assignee: Konishiroku Photo Industry Co., Ltd., Tokyo, Japan

[21] Appl. No.: 935,154

[22] Filed: Nov. 25, 1986

Related U.S. Application Data

[63] Continuation of Ser. No. 782,066, Sep. 30, 1985, abandoned.

[30] Foreign Application Priority Data

Oct. 5, 1984 [JP] Japan ..... 59-209535

[51] Int. Cl.[4] ..... G03C 1/30; G03C 1/34; G03C 1/20; G03C 1/40

[52] U.S. Cl. ..... 430/550; 430/552; 430/553; 430/607; 430/614; 430/626; 430/567; 430/551; 430/566

[58] Field of Search ..... 430/550, 552, 553, 607, 430/614, 626, 567, 551, 566

[56] References Cited

U.S. PATENT DOCUMENTS

| | | | |
|---|---|---|---|
| 2,165,421 | 7/1939 | Sheppard et al. | 430/607 |
| 2,751,297 | 6/1956 | Hood et al. | 430/614 |
| 3,236,652 | 2/1966 | Kennard et al. | 430/607 |
| 3,420,670 | 1/1969 | Milton | 430/614 |
| 3,881,933 | 5/1975 | Kumai et al. | 430/626 |
| 4,401,754 | 8/1983 | Suzuki et al. | 430/607 |
| 4,429,039 | 1/1984 | Ochiai | 430/626 |
| 4,554,243 | 11/1985 | Ono et al. | 430/614 |

FOREIGN PATENT DOCUMENTS

| | | | |
|---|---|---|---|
| 52-11029 | 7/1975 | Japan | 430/607 |

*Primary Examiner*—Won H. Louie

*Attorney, Agent, or Firm*—Frishauf, Holtz, Goodman & Woodward

[57] ABSTRACT

A silver halide photographic light-sensitive material which is excellent in raw-stock preservability, physical characteristics of its layers such as glossiness, scratch resistance, and degree of swelling and whose sensitivity changes very little with time after manufacture comprising a compound represented by Formula [I] of the specification, hardened with at least one of the compounds represented by Formula [II] or [III] of the specification. The storage stability is further improved when at least one of the cyan couplers represented by Formula [IX] or [X] of the specification is present.

16 Claims, No Drawings

SILVER HALIDE PHOTOGRAPHIC LIGHT-SENSITIVE MATERIAL

This application is a continuation of application Ser. No. 782,066, filed Sept. 30, 1985, abandoned.

BACKGROUND OF THE INVENTION

The present invention relates to a silver halide photographic light-sensitive material, and more particularly to a silver halide photographic light-sensitive material which is excellent in the layer's physical characteristics as well as in the raw-stock preservability.

A silver halide photographic light-sensitive material (hereinafter may be called "light-sensitive material" unless confusion occurs) is prepared so as to comprise photographic layers such as light-sensitive silver halide emulsion layers and subsidiary function-having various sub-layers such as anti-irradiation layer, antihalation layer, intermediate layer for intercepting the interlayer effect, filter layer, protective layer, and the like, while a silver halide color photographic light-sensitive material (hereinafter may be called "color light-sensitive material" unless confusion occurs) comprises silver halide emulsion layers containing couplers that will form specified spectral-region colors conformed to a fixed order.

The photographic layers of such light-sensitive materials use a hydrophilic colloid such as gelatin as the binder thereof, and the binder is usually subjected to hardening treatment to meet the need of having the light-sensitive material withstand recent high-temperature/high-pH rapid processings and mechanical processings in automatic processors that tend to cause troubles such as scratches, pressure marks, etc.

The hardening treatment is essential for insuring the processed quality in the aspect of physical properties except for special cases, and as the agent for use in the hardening treatment various hardeners ranging from incipient inorganic-compound hardeners such as potassium alum, chrome alum, etc., to organic hardeners which are more highly adaptable to photographic characteristics have so far been studied and used to date.

For example, the organic hardener includes those chlorotriazine-type hardeners as described in U.S. Pat. Nos. 3,325,287, 3,645,743 and Japanese Patent Publication Open to Public Inspection (hereinafter referred to as Japanese Patent O.P.I. Publication) No. 40244/1982, those vinyl sulfone-type hardeners as described in U.S. Pat. No. 3,490,911 and West German OLS Pat. No. 2,749,260, and various other hardeners such as aldehyde-type, epoxy-type and the like compounds.

The hardener, on the assumption that it has a matter-of-course hardening effect, is required to have the characteristics that the hardening by the hardener be capable of producing a gloss on the surface of the layer of a light-sensitive material, of making the layer adhere well to the support, of making progress fast, and of making the layer well resistant against scratching force; and the hardener being harmless to photographic characteristics and having no possibility to cause any industrial-hygienic or environmental-pollution problems.

In view of these requirements, for example, S-triazine-type hardeners are disadvantageous in respect that they lack rapid-hardening ability, and vinyl sulfone-type hardeners are also disadvantageous in respect that they are lacking in making the surface of the layer glossy as well as in making the layer adhere to the support and resistant against scratching force, whereas chlorotriazine-type hardeners have at least satisfactory characteristics which meet the above physical characteristic requirements, as described in Japanese Patent Examined Publication No. 6151/1972, Japanese Patent O.P.I. Publication Nos. 19220/1973, 78788/1976, 128130/1977, 130326/1977 and 1043/1981.

The chlorotriazine-type hardener, however, has a large disadvantage that, when it is used in a color photographic light-sensitive material for making color prints, the preservability of the light-sensitive material as a raw stock during the period from its manufacture up to the time when it is used (hereinafter called "raw-stock preservability") is so poor that the sensitivity of the light-sensitive material is largely deteriorated with time.

SUMMARY OF THE INVENTION

Object of the Invention

It is an object of the present invention to provide a silver halide photographic light-sensitive material which is excellent in the raw-stock preservability as well as in the layer's physical characteristics.

Construction of the Invention

As a result of our continued investigation it has now been found that the above object of the present invention is accomplished by a silver halide photographic light-sensitive material comprising a layer which contains a compound having the following Formula [I] and which is hardened by at least one of compounds having the following Formula [II] or [III].

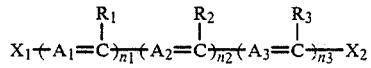

Formula [I]

wherein $R_1$, $R_2$ and $R_3$ each is a hydrogen atom, a halogen atom, a sulfonic acid group (including a salt thereof) or a monovalent organic acid group; $A_1$, $A_2$ and $A_3$ each is a nitrogen atom or a

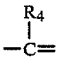

group [wherein $R_4$ is a hydrogen atom, a halogen atom, a sulfonic acid group (including a salt thereof) or a monovalent organic group]; and $X_1$ and $X_2$ each is a hydroxyl group or a $-NR_5R_6$ (wherein $R_5$ and $R_6$ each is a hydrogen atom, an alkyl, aryl or alkylcarbonyl group, provided the $R_5$ and $R_6$ may combine with each other to form a ring), provided that the $R_1$, $R_2$, $R_3$ and $R_4$ each may combine with one another to form a ring, and further at least one of these groups represented by the $R_1$, $R_2$, $R_3$ and $R_4$ and at least one of these groups represented by the $R_5$ and $R_6$ may combine with each other to form a ring;

and $n_1$, $n_2$ and $n_3$ each is an integer of from zero to 3.

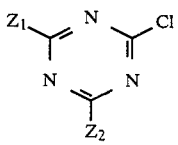

Formula [II]

wherein $Z_1$ is a chlorine atom, a hydroxy, alkyl, alkoxy, alkylthio, —OM (wherein M is a monovalent metallic atom), —NR'R" of —NHCOR'" group (wherein R', R" and R'" each is a hydrogen atom, an alkyl or aryl group); and $Z_2$ is as defined in $Z_1$ except that the chlorine atom is excluded.

Formula [III]

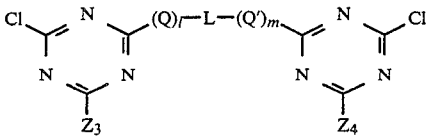

wherein $Z_3$ and $Z_4$ each is a chlorine atom, a hydroxy, alkyl, alkoxy or —OM group (wherein M is a monovalent metallic atom); Q and Q' each is a linkage group representing —O—, —S— or —NH—; L is an alkylene or arylene group; and l and m each is zero or 1.

DETAILED DESCRIPTION OF THE INVENTION

The present invention will be illustrated further in detail.

In the foregoing Formula [I], the halogen atom represented by each of the $R_1$, $R_2$, $R_3$ and $R_4$ is, e.g., a chlorine atom, a bromine atom, etc., and typical ones of the monovalent organic group include, e.g., hydroxyl group, cyano group, amino group, alkyl groups (such as methyl, ethyl, butyl, octyl, dodecyl, benzyl, phenethyl, etc.), alkenyl groups (such as propenyl, etc.), alkoxy groups (such as methoxy, ethoxy, propoxy, butoxy, pentoxy, aryloxy, benzyloxy, etc.), aryl groups (such as phenyl, tolyl, naphthyl, chlorophenyl, cyclohexylphenyl, cyanophenyl, etc.), aryloxy groups (such as phenoxy, tolyloxy, naphthoxy, chlorophenyoxy, hydroxyphenyloxy, etc.), alkylsulfamoyl groups (such as methylsulfamoyl, ethylsulfamoyl, benzylsulfamoyl, etc.), arylsulfamoyl groups (such as phenylsulfamoyl, naphthylsulfamoyl, etc.), hydroxycarbonyl group, alkylcarbonyl groups (such as methylcarbonyl, ethylcarbonyl, pentylcarbonyl, etc.), arylcarbonyl groups (such as phenylcarbonyl, tolylcarbonyl, naphthylcarbonyl, etc.), heterocyclic groups (such as furyl, thiazolyl, imidazolyl, succinimido, benzoxazolyl, phthalimido, etc.), alkylthio groups (such as methylthio, ethylthio, propylthio, etc.), arylthio groups (such as phenylthio, naphthylthio, etc.), heterothio groups (such as thiazolylthio, imidazolylthio, triazolylthio, benzoxazolylthio, benzothiazolylthio, etc.), alkyloxycarbonyl groups (such as methoxycarbonyl, ethoxycarbonyl, etc.), aryloxycarbonyl groups (such as phenoxycarbonyl, naphthyloxycarbonyl, etc.), alkylcarbonylamino groups (such as methylcarbonylamino, ethylcarbonylamino, etc.), arylcarbonylamino groups (such as benzoylamino, naphthoylamino, etc.), alkylsulfonyl groups (such as methylsulfonyl, ethylsulfonyl, propylsulfonyl, dodecylsulfonyl, etc.), arylsulfonyl groups (such as phenylsulfonyl, etc.), alkylacyloxy groups (such as acetyloxy, cyclohexylcarbonyloxy, etc.), arylacyloxy groups (such as benzoyloxy, etc.), alkylamino groups (such as ethylamino, dimethylamino, diethanlamino, etc.), arylamino groups (such as anilino, etc.), alkylcarbamoyl groups (such as ethylcarbamoyl, etc.), arylcarbamoyl groups (such as phenylcarbamoyl, etc.), alkylsulfonamido groups (such as methylsulfonamido, ethylsulfonamido, etc.), arylsulfonamido groups (such as benzenesulfonamido, etc.), cycloalkyl groups (such as cyclohexyl, etc.), cycloalkyloxy groups (such as cyclohexyloxy, etc.), and the like.

In Formula [I], the combined ring formed by the $R_1$, $R_2$, $R_3$ and $R_4$, and the combined ring formed by at least one of the groups represented by the $R_1$, $R_2$, $R_3$ and $R_4$ and at least one of the groups represented by the $R_5$ and $R_6$ include, e.g., aromatic rings (such as benzene ring, naphthalene ring, etc.), cycloolefin rings (such as cyclohexene ring, etc.), heterocyclic rings (such as furan ring, imidazole ring, etc.), and the like.

In Formula [I], the preferred alkyl groups represented by the $R_5$ or $R_6$ are straight-chain or branched-chain alkyl groups having from 1 to 5 carbon atoms (such as methyl, ethyl, butyl, etc.), and in the case where these alkyl groups have substituents, the substituents include hydroxyl group, hydroxycarbonyl group, cyano group, aryl groups (such as phenyl, tolyl, etc.), alkyloxycarbonyl groups (such as ethoxycarbonyl, hexadecyloxycarbonyl, etc.), aryloxycarbonyl groups (such as phenoxycarbonyl, tolyloxycarbonyl, naphthyloxycarbonyl, etc.), alkylsulfonamido groups (such as methanesulfonamido, etc.), acylamino groups (such as acetamido, benzamido, etc.), alkoxy groups (such as methoxy, benzyloxy, etc.), aryloxy groups (such as phenoxy, etc.), sulfonyl groups (such as methanesulfonyl, etc.), and the like.

The aryl group represented by the $R_5$ or $R_6$ is, for example, a phenyl or naphthyl group, and preferably a phenyl group. Where the phenyl group has a substituent, the substituent includes, e.g., halogen atoms (such as chlorine, bromine, etc.), hydroxyl group, nitro group, cyano group, hydroxycarbonyl group, alkyl groups (straight-chain or brached-chain alkyl groups such as methyl, ethyl, propyl, butyl, amyl, octyl, decyl, dodecyl, hexadecyl, octadecyl, etc.), alkoxy groups (such as methoxy, ethoxy, propoxy, butoxy, pentyloxy), and the like.

The alkylcarbonyl group represented by the $R_5$ or $R_6$ is a methylcarbonyl group, butylcarbonyl group, or the like.

Of those compounds represented by Formula [I] the preferred ones are those having the following Formula [IV] or [V]:

Formula [IV]

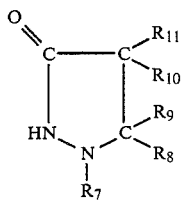

wherein $R_7$ is a hydrogen atom, an alkyl group (preferably an alkyl group having from 1 to 4 carbon atoms) or an aryl group (preferably a phenyl group); and $R_8$, $R_9$, $R_{10}$ and $R_{11}$ each is a hydrogen atom, an alkyl group (preferably an alkyl group having from 1 to 4 carbon atoms), an aryl group (preferably a phenyl group) or a hydroxyl group. The above alkyl group may have a substituent which includes, e.g., halogen atoms, hydroxyl group, carboxyl group, amino group, and the like. The above aryl group may have a substituent which includes, e.g., halogen atoms, alkyl groups, alkoxy groups, hydroxyl groups, hydroxycarbonyl group, and the like.

Formula [V]

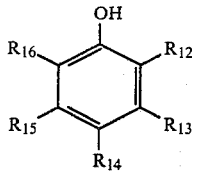

wherein $R_{12}$, $R_{13}$, $R_{14}$, $R_{15}$ and $R_{16}$ each is a hydrogen atom, a halogen atom, a sulfonic acid group (including a salt thereof) or a monovalent organic group, provided that at least one of the $R_{12}$, $R_{14}$ and $R_{15}$ is a hydroxyl group or $—NR_{17}R_{18}$ (wherein $R_{17}$ and $R_{18}$ are as defined in the $R_5$ and $R_6$, respectively, in Formula [I]), and further the $R_{12}$, $R_{13}$, $R_{15}$ and $R_{16}$ are allowed to combine with one another to form a combined ring. In addition, the monovalent organic group represented by each of the $R_{12}$, $R_{13}$, $R_{14}$, $R_{15}$ and $R_{16}$ is as defined in the monovalent organic group represented by each of the $R_1$, $R_2$, $R_3$ and $R_4$ in formula [I].

Of those compounds represented by Formula [V] the more preferred compounds are those having the following Formula [VI]:

Formula [VI]

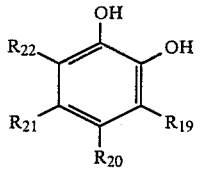

wherein $R_{19}$, $R_{20}$, $R_{21}$ and $R_{22}$ each is a hydrogen atom, an alkyl, alkoxy, cycloalkyl, cycloalkyloxy, aryl, aryloxy, alkylcarbonyloxy or alkyloxycarbonyl group.

In Formula [VI], the alkyl group represented by each of the $R_{19}$, $R_{20}$, $R_{21}$ and $R_{22}$ includes, e.g., methyl group, ethyl group, propyl group, butyl group, octyl group, hydroxyethyl group, and the like; the alkoxy group includes, e.g., methoxy group, ethoxy group, butoxy group, and the like; the cycloalkyl group includes, e.g., cyclopentyl group, cyclohexyl group, adamantyl group, and the like; the cycloalkyloxy group includes, e.g., cyclopentyloxy group, cyclohexyloxy group, and the like; the aryl group includes, e.g., phenyl group, hydroxyphenyl group, tolyl group, and the like; the aryloxy group includes, e.g., phenoxy group, tolyloxy group, and the like; the alkylcarbonyloxy group includes, e.g., methylcarbonyloxy group, ethylcarbonyloxy group, butylcarbonyloxy group, and the like; and the alkyloxycarbonyl group includes, e.g., methyloxycarbonyl group, propylethyloxycarbonyl group, propyloxycarbonyl group, and the like. Further, the $R_{19}$, $R_{20}$, $R_{21}$ and $R_{22}$ are allowed to combine with one another to form a ring.

The following are examples of the compound having Formula [I], but the present invention is not limited thereto.

X-1

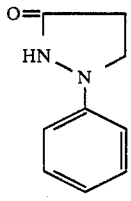

-continued

X-2

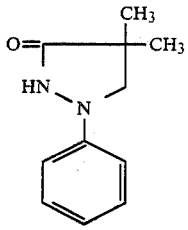

X-3

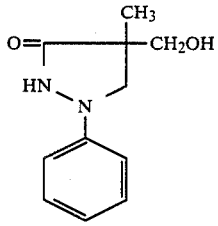

X-4

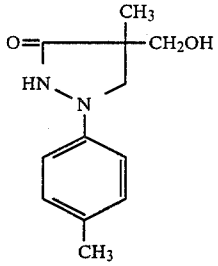

X-5

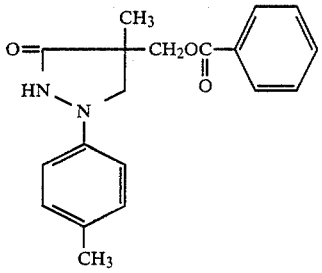

X-6

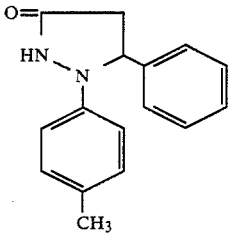

X-7

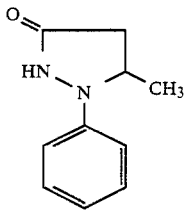

-continued
X-8
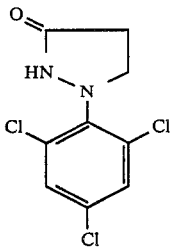
X-9
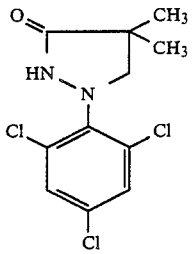
X-10
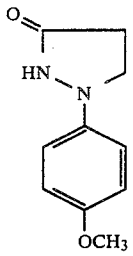
X-11
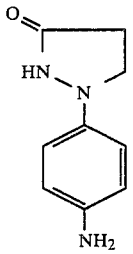
X-12
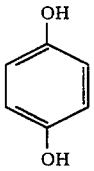
X-13
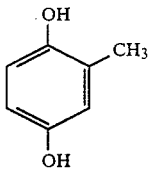
X-14
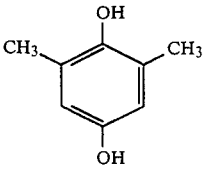
-continued
X-15
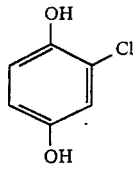
X-16
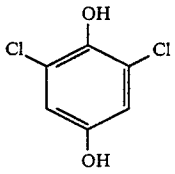
X-17
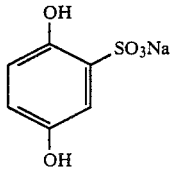
X-18
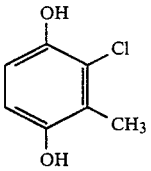
X-19
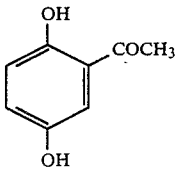
X-20
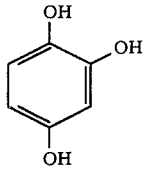
X-21
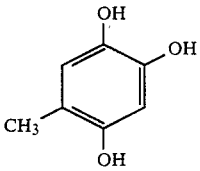
X-22
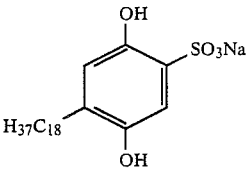
X-23
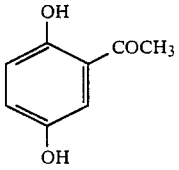

-continued
X-24
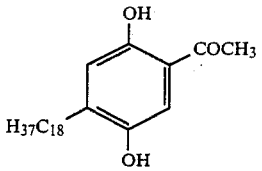
X-25
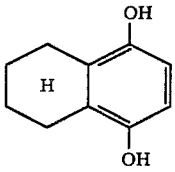
X-26
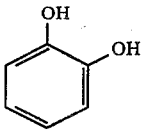
X-27
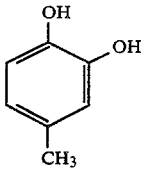
X-28
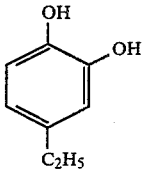
X-29
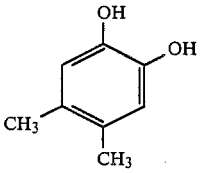
X-30
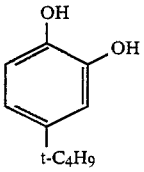
X-31
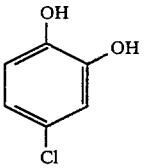
X-32
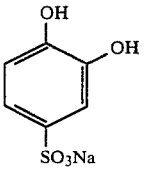
-continued
X-33
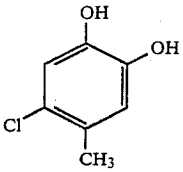
X-34
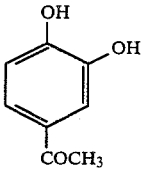
X-35
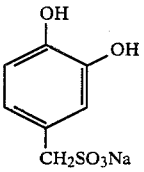
X-36
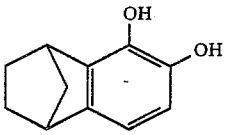
X-37
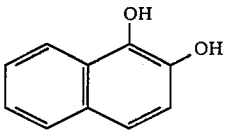
X-38
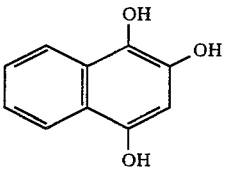
X-39
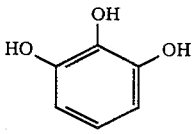
X-40
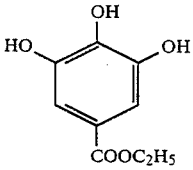
X-41
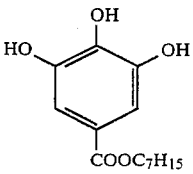

-continued

X-42

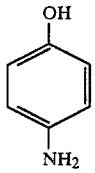

X-43

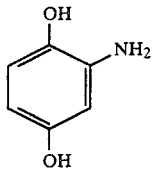

X-44

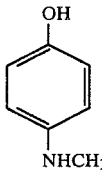

X-45

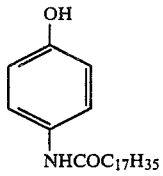

X-46

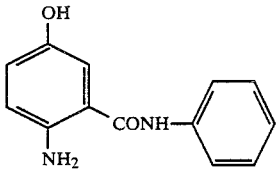

X-47

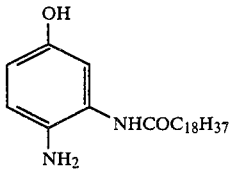

X-48

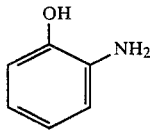

X-49

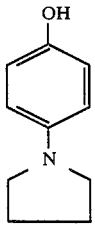

-continued

X-50

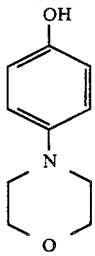

X-51

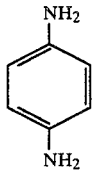

X-52

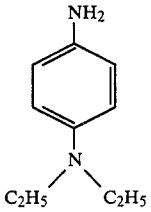

X-53

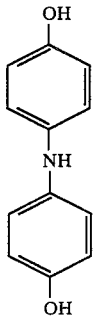

X-54

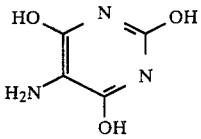

X-55

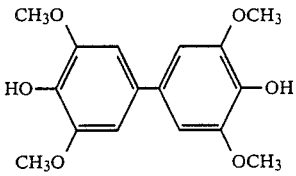

X-56

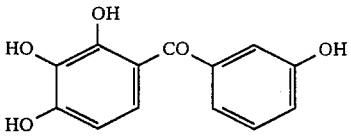

The incorporation of any of the compounds having Formula [I] of this invention into a silver halide photographic light-sensitive material may be made in the manner that the compound is dissolved in water or an organic solvent miscible in an arbitrary proportion with water (such as methanol, ethanol, etc.), or dissolved into an organic solvent which may not be miscible with water, which solution is then dispersed into a hydrophilic colloid, and thus the compound, in either the solution form or the dispersed liquid form, is added to the silver halide light-sensitive material. The adding quantity of the compound is preferably from $1.0\times10^{-4}$ to 1.0 mole per mole of silver halide, and more preferably from $1.2\times10^{-3}$ to $1.0\times10^{-1}$ mole. The addition of the compound is allowed to be made at any point of time during the period between the preparation and the coating of the silver halide emulsion, and preferably between the completion point of the chemical ripening and the starting point of the coating of the silver halide emulsion. The place where the addition is to be made is the arbitrary light-sensitive silver halide emulsion layer and/or nonlight-sensitive hydrophilic colloid layer, and preferably the layer comprising a light-sensitive silver halide emulsion spectrally sensitized by use of a compound having Formula [VII] or [VIII] that will be described hereinafter and/or the nonlight-sensitive hydrophilic colloid layer adjacent thereto.

The incorporation of the compound having Formula [I] of this invention into a silver halide emulsion layer is of the well known prior art and found in, e.g., British Pat. No. 2,054,187, U.S. Pat. Nos. 3,582,333, 3,671,248, 3,902,905, 3,522,053, Japanese Patent O.P.I. Publication Nos. 52743/1981, 28741/1983, and the like. The techniques described in these publications, however, are intended for the improvement of developability, the prevention of the occurrence of fog, and the like, and from the above prior-art publications, the effect of improving the change in the sensitivity of the raw stock in storage intended in this invention was not expected at all. And Japanese Patent O.P.I. Publication No. 176637/1983 discloses a technique of improving the sensitivity change of the raw stock in storage by the incorporation of a black-and-white developing agent in a quantity not exceeding 130 mg per mole of silver halide into a specific sensitizing dye-containing light-sensitive material, but even though this method is applied to the present invention, the preservability of the raw stock in storage cannot be improved adequately, and therefore the method is unable to accomplish the object of the present invention.

The alkyl group represented by each of the $Z_1$ and $Z_2$ of the foregoing Formula [II] includes, e.g., methyl group, ethyl group, butyl group, and the like; and the alkoxy group includes, e.g., methoxy group, ethoxy group, butoxy group, and the like. The M of the —OM group represented by each of the $Z_1$ and $Z_2$ represents a sodium atom or potassium atom.

The chlorotriazine-type hardeners having Formula [II] are those described in U.S. Pat. No. 3,645,743, Japanese Patent Examined Publication Nos. 6151/1972, 33380/1972, 9607/1976, Japanese Patent O.P.I. Publication Nos. 19220/1973, 78788/1976, 60612/1977, 128130/1977, 130326/1977 and 1043/1981. From these hardeners any appropriate one may be selected in accordance with the foregoing basis and used in this invention.

The alkyl group represented by each of the $Z_3$ and $Z_4$ of the foregoing Formula [III] includes, e.g., methyl group, ethyl group, butyl group and the like; the alkoxy group includes, e.g., methoxy group, ethoxy group, butoxy group, and the like; and the M of the —OM group represents a sodium atom or potassium atom.

The alkylene group represented by the L of Formula [III] includes, e.g., $-CH_2-$, $-(CH_2)_2-$, $-(CH_2)_3-$, and the like; and the arylene group includes, e.g., p-, o- and m-phenylene groups, and the like.

The chlorotriazine-type hardeners having Formula [III] are those described in Canadian Pat. No. 895,808, Japanese Patent Examined Publication No. 33542/1983, and Japanese Patent O.P.I. Publication No. 40244/1982. From these hardeners any appropriate one may be selected in accordance with the foregoing basis.

Any of the compounds having Formula [II] or [III], since it becomes normally diffused to be extended across the whole layers, may be added to at least one layer or a plurality of layers selected from the emulsion layers or subsidiary layers. The addition is carried out by adding a solution of the compound dissolved into water or an alcohol (e.g., methyl alcohol or ethyl alcohol) in a quantity of 1–1000 mg, and preferably 5–50 mg per gram of gelatin. The addition may be made by either the batch method or the in-line method.

The following are typical examples of the compounds having Formula [II] and Formula [III], but the present invention is not limited thereto.

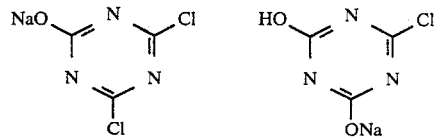
(II-1)

(II-2)

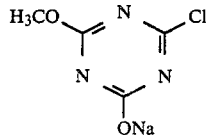
(II-3)

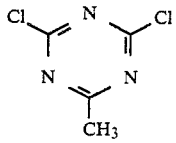
(II-4)

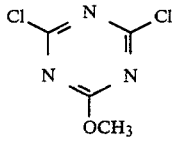
(II-5)

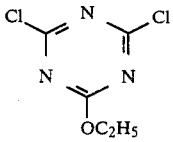
(II-6)

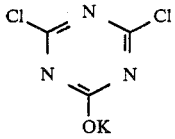
(II-7)

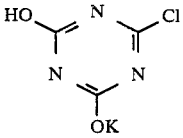
(II-8)

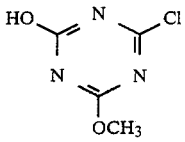
(II-9)

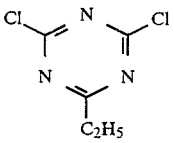
(II-10)

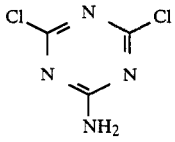
(II-11)

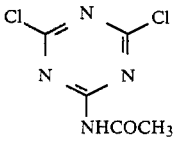
(II-12)

-continued

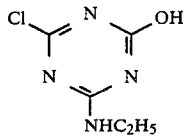

(II-13)

Compounds having Formula [III]

(III-1)

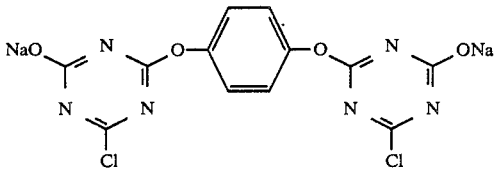

(III-2)

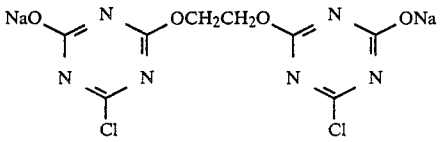

(III-3)

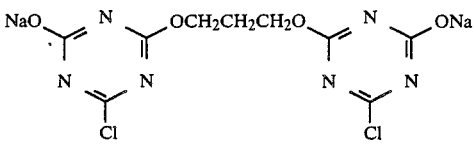

(III-4)

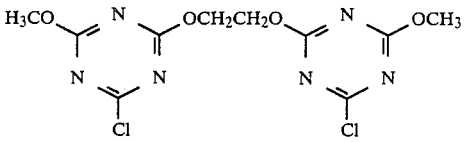

(III-5)

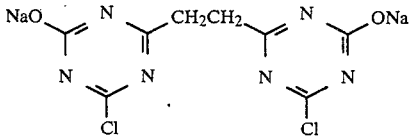

(III-6)

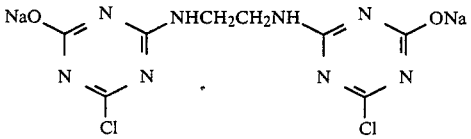

(III-7)

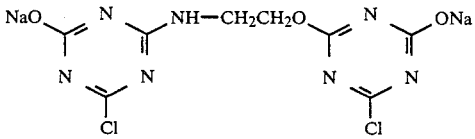

(III-8)

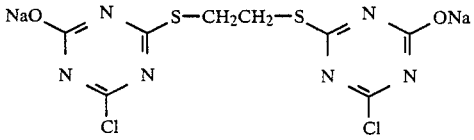

-continued (III-9)

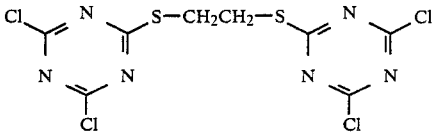

(III-10)

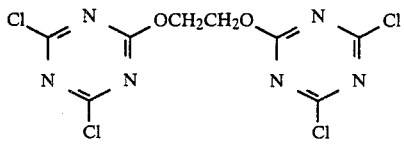

The silver halide to be used in the silver halide emulsion of this invention includes any arbitrary ones used in ordinary silver halide emulsions such as silver bromide, silver chloride, silver iodobromide, silver chlorobromide, silver chloroiodobromide, and the like. The particles of these silver halides may be either coarse-grained or fine-grained, and the particle-size distribution may be either narrower or wider. The crystal form of these silver halide particles may be either regular or twin, and those whose crystal is of an arbitrary [100] face[111] face proportion may be used. Further, the crystal of these silver halide particles may be of either homogeneous structure from the inside through outside or heterogeneous structure stratified with the inside and the outside. In addition, these silver halides may be of either the type of forming a latent image mainly on the particle surface or the type of forming a latent image inside the particle. Further, these silver halides may be ones prepared by any of the neutral method, ammoniacal method, and acid method. Also, silver halide particles prepared by any of the simultaneously mixing method, orderly mixing method, reversely mixing method and conversion method may be applied to this invention.

The particle size is desirable to be in the range of from 0.1 to 1.0$\mu$.

The silver halide emulsion to be used in the light-sensitive material of this invention is preferably one from which the water-soluble salt is removed, but may also be one not desalted. Further a silver halide emulsion produced by mixing two or more different emulsions each prepared separately may also be used in this invention.

The silver halide photographic emulsion prepared by dispersing silver halide particles into a binder liquid may be sensitized by use of chemical sensitizers. The chemical sensitizers advantageously usable in this invention may be broadly divided into four groups: noble-metal sensitizers, sulfur sensitizers, selenium sensitizers and reduction sensitizers.

The usable noble-metal sensitizers include gold compounds and those compounds of rhuthenium, rhodium, palladium, platinum, and the like.

In addition, when gold sensitizers are used, ammonium thiocyanate or sodium thiocyanate may be used together.

The usable sulfur sensitizers include active gelatin and sulfur compounds.

The usable selenium sensitizers include active and inert selenium compounds.

The usable reduction sensitizers include stannous salts, polyamines, bisalkylaminosulfides, silane compounds, iminoaminomethanesulfinic acid, hydrazinium salts, and hydrazine derivatives.

The silver halide emulsion, in order to be made sensitive to desired wavelength regions, may be spectrally sensitized by use of various sensitizers. The sensitizers suitably usable for this purpose include those cyanine dyes, merocyanine dyes and complex cyanine dyes as described in, e.g., U.S. Pat. Nos. 1,939,201, 2,072,908, 2,739,149, 2,213,995, 2,493,748, 2,519,001, West German Pat. No. 929,080, and British Pat. No. 505,979, which cyanine dyes may be used alone or in combination. Such various spectral sensitizers may also be used for purposes aside from the intrinsic purpose thereof; for example, they may be used for the prevention of fog, for the prevention of possible deterioration during the storage of the photographic characteristics of silver halide color photographic light-sensitive materials, and for the development control (e.g., gradation control, etc.).

Further, the particularly preferred sensitizing dyes for this invention are those having the following Formula [VII] and Formula [VIII]. The present invention has conspicuous effects particularly upon emulsions spectrally sensitized by these sensitizing dyes.

Formula [VII]

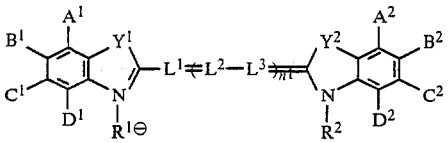

$(X^{\ominus})_{l1}$

-continued

Formula [VIII]

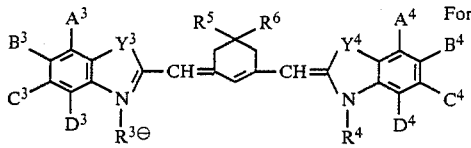

$(X^{\ominus})_{l2}$ wherein $Y^1$, $Y^2$, $Y^3$ and $Y^4$ each is an oxygen atom, a sulfur atom or a selenium atom; $A^1$, $A^2$, $A^3$, $A^4$, $B^1$, $B^2$, $B^3$, $B^4$, $C^1$, $C^2$, $C^3$, $C^4$, $D^1$, $D^2$, $D^3$ and $D^4$ each is a hydrogen atom, a halogen atom, an alkyl, alkoxy, phenyl, cyano, nitro or alkoxycarbonyl group, provided that at least one of $A^1$–$B^1$, $B^1$–$C^1$, $C^1$–$D^1$, $A^2$–$B^2$, $B^2$–$C^2$, $C^2$–$D^2$, $A^3$–$B^3$, $B^3$–$C^3$, $C^3$–$D^3$, $A^4$–$B^4$, $B^4$–$C^4$, and $C^4$–$D^4$ combinations may combine to form a benzene ring; $R^1$, $R^2$, $R^3$ and $R^4$ each is an alkyl or aryl group; $R^5$ and $R^6$ each is a lower alkyl group; $L^1$, $L^2$ and $L^3$ each is a methine group; $X^{\ominus}$ represents an acidic ion; $n^1$ is 1 or 2; and $l^1$ is zero or 1, provided that when the compound forms an intramolecular salt, the $l^1$ represents zero.

The methine group (—CH=) represented by each of the $L^1$, $L^2$ and $L^3$ is allowed to have a substituent, and the substituent includes straight-chain or branched-chain alkyl groups (such as methyl, ethyl, etc.), alkoxy groups (such as methoxy, ethoxy, etc.), and the like.

The following are examples of the sensitizing dyes having Formula [VII] and Formula [VIII].

D-1

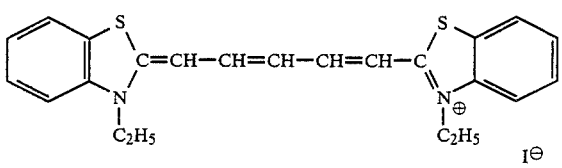

D-2

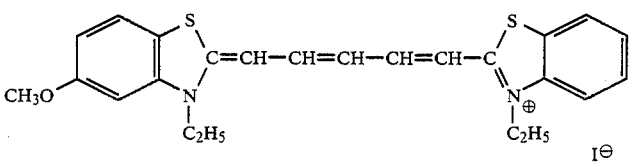

D-3

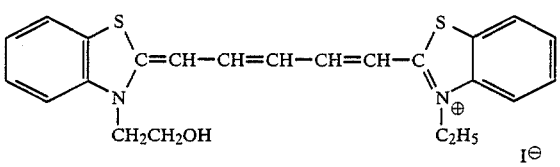

D-4

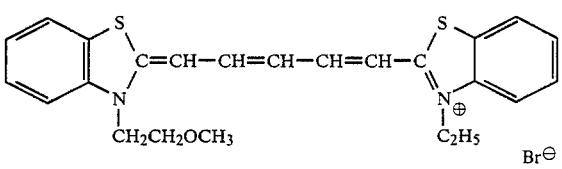

D-5

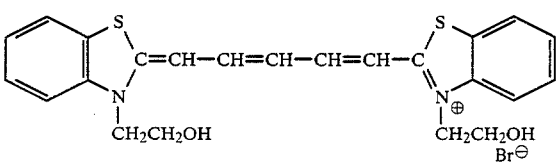

D-6

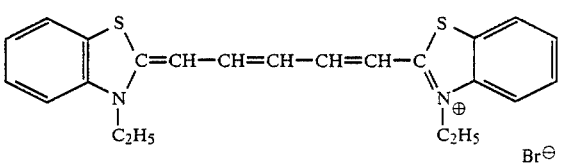

-continued
D-7
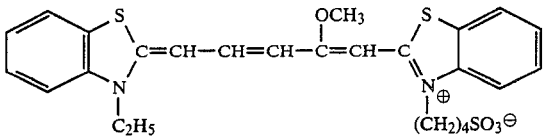
D-8
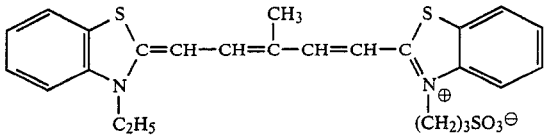
D-9
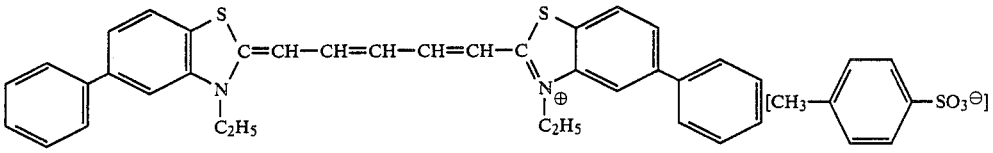
D-10
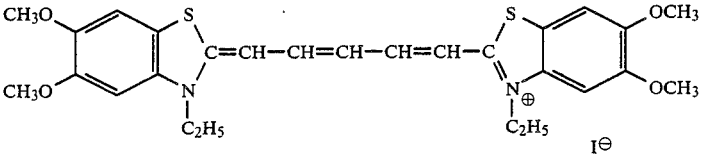
D-11
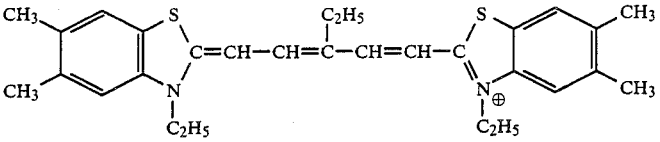
D-12
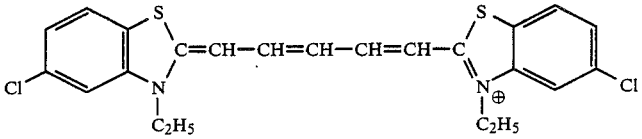
D-13
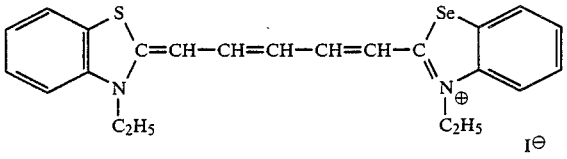
D-14
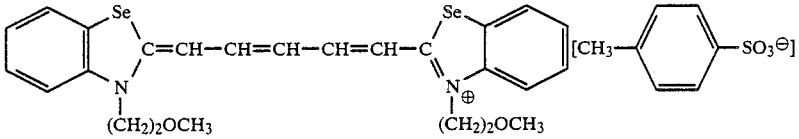
D-15
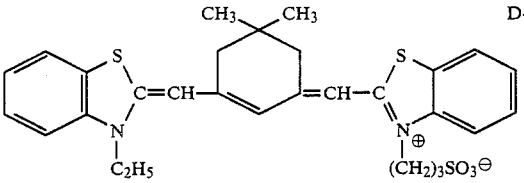
D-16
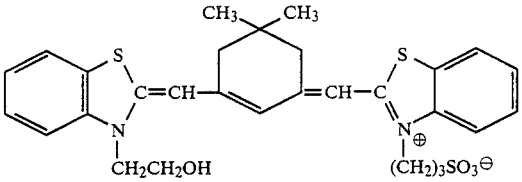
D-17
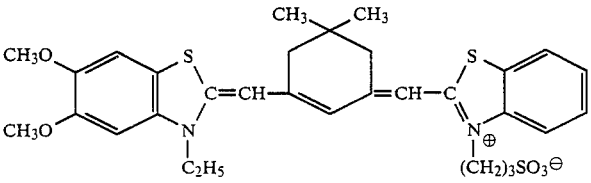

-continued
D-18
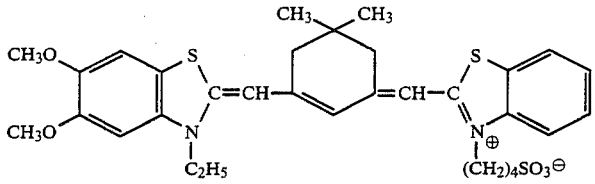
D-19
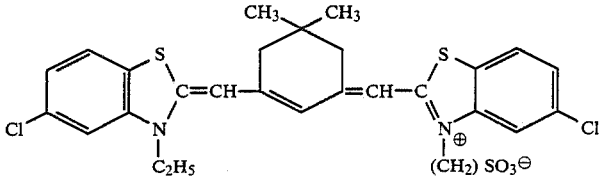
D-20
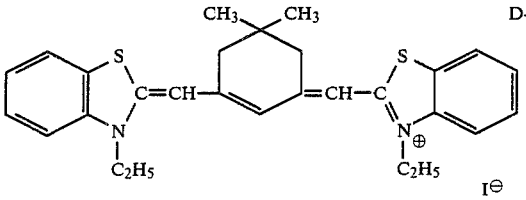
D-21
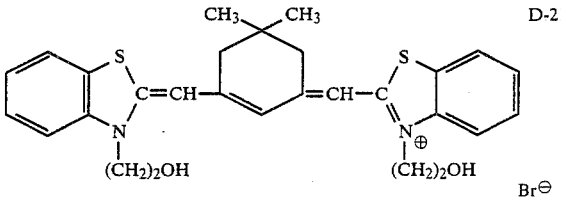
D-22
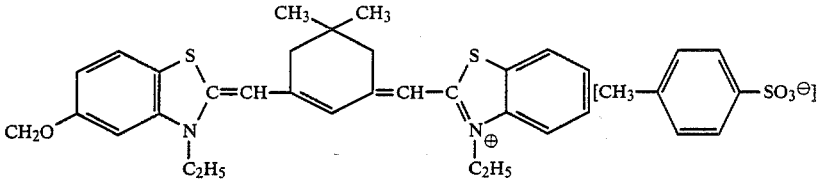
D-23
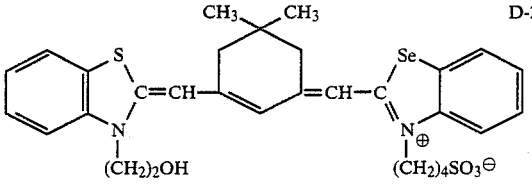
D-24
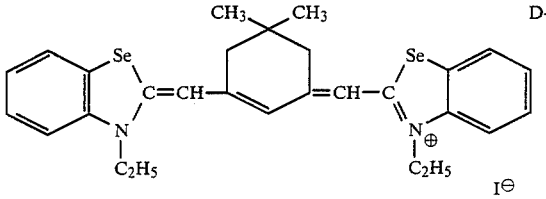
D-25
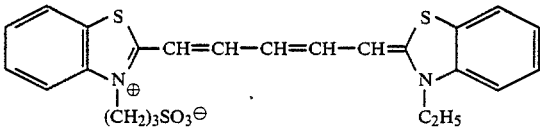
D-26
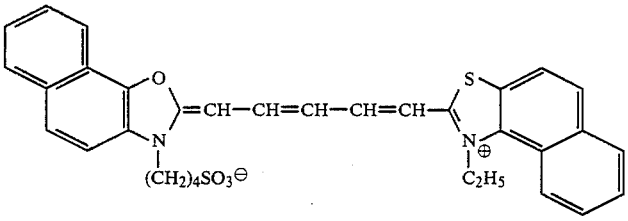
D-27
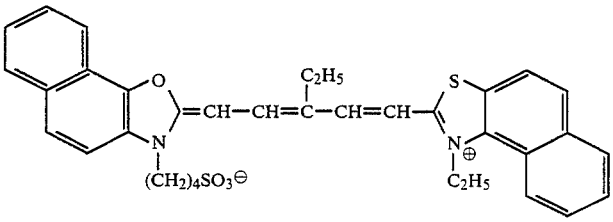

-continued

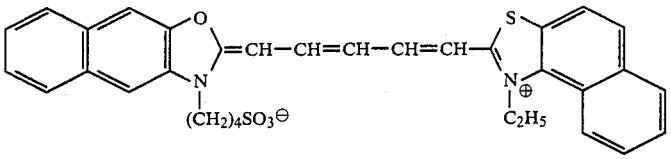

D-28

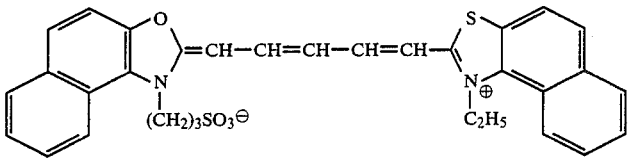

D-29

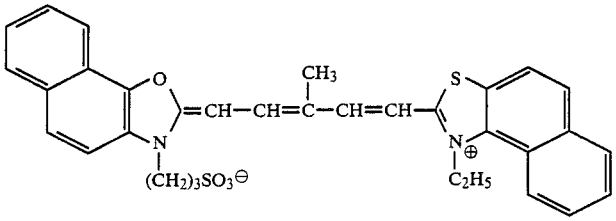

D-30

The addition of these sensitizing dyes is carried out by adding a solution of any of the sensitizing dyes at any point of time during the chemical ripening of the emulsion, or after completion of the chemical ripening, or before or after the addition of stabilizer and antifoggant. The adding quantity of the sensitizing dye, although no particular restrictions are placed thereon, is in the range of normally from $1\times10^{-6}$ to $1\times10^{-4}$ mole per mole of silver halide, and preferably from $5\times10^{-6}$ to $5\times10^{-5}$ mole.

These sensitizing dyes of this invention may be used alone or in combination. Further, along with the sensitizing dye, a substance that exhibits a supersensitizing effect; i.e., a supersensitizer, may, if necessary, be used.

The component layers of the silver halide photographic light-sensitive material of this invention may, if necessary, and within the range not to impair the effect of this invention, contain any of such chemical sensitizers as thioether compounds, quaternary ammonium salt compounds, polyalkylene oxide compounds, or the like, and any of such stabilizers as triazoles, azaindenes, benzothiazolium compounds, zinc compounds, cadmium compounds, mercaptan compounds, or the like.

In applying this invention to a color photographic light-sensitive material, nondiffusible couplers that form colors by the coupling reaction thereof with an aromatic primary amine color developing agent may be used. Of these couplers the yellow dye image forming coupler is typified by those acylacetamido-type, benzoylmethane-type four-equivalent and two-equivalent couplers as described in, e.g., U.S. Pat. Nos. 2,186,849, 2,322,027, 2,728,658, 2,875,057, 3,265,506, 3,277,155, 3,408,194, 3,415,652, 3,447,928, 3,664,841, 3,770,446, 3,778,277, 3,849,140, 3,894,875, British Patent Nos. 778,089, 808,276, 875,476, 1,402,511, 1,421,126, 1,513,832, Japanese Patent Examined Publication No. 13576/1974, Japanese Patent O.P.I. Publication Nos. 29432/1973, 66834/1973, 10736/1974, 122355/1974, 28834/1975, 132926/1975, 138832/1975, 3631/1976, 17438/1976, 26038/1976, 26039/1976, 50734/1976, 53825/1976, 75521/1976, 89728/1976, 102636/1976, 107137/1976, 117031/1976, 122439/1976, 143319/1976, 9529/1978, 82332/1978, 135625/1978, 145619/1978, 23528/1979, 58541/1979, 65035/1979, 133329/1979, 598/1980, and the like.

Typical magenta dye image-forming couplers are those 5-pyrazolone-type, pyrazolotriazole-type, pyrazolinobenzimidazole-type, indazolone-type, cyanoacetyl-type four-equivalent and two-equivalent magenta dye image-forming couplers as described in, e.g., U.S. Pat. Nos. 1,969,479, 2,213,986, 2,294,909, 2,338,677, 2,340,763, 2,343,703, 2,359,332, 2,411,951, 2,435,550, 2,592,303, 2,600,788, 2,618,641, 2,619,419, 2,673,801, 2,691,659, 2,803,554, 2,829,957, 2,866,706, 2,881,167, 2,895,826, 3,602,653, 3,127,269, 3,214,437, 3,253,924, 3,311,476, 3,419,391, 3,486,894, 3,519,429, 3,558,318, 3,617,291, 3,684,514, 3,705,896, 3,725,067, 3,888,680, British Pat. Nos. 720,284, 737,700, 813,866, 892,886, 918,128, 1,019,117, 1,042,832, 1,047,612, 1,398,828, 1,398,979, West German Pat. Nos. 814,996, 1,070,030, Belgian Pat. No. 724,427, Japanese Patent O.P.I. Pat. Nos. 60479/1971, 29639/1974, 111631/1974, 129538/1974, 13041/1975, 116471/1975, 159336/1975, 3232/1976, 3233/1976, 10935/1976, 16924/1976, 20826/1976, 26541/1976, 30228/1976, 36938/1976, 37230/1976, 37646/1976, 39039/1976, 44927/1976, 104344/1976, 105820/1976, 108842/1976, 112341/1976, 112342/1976, 112343/1976, 112344/1976, 117032/1976, 126831/1976, 31738/1977, 9122/1978, 55122/1978, 75930/1978, 86214/1978, 125835/1978, 123129/1978, 56429/1979 and 35838/1982; and Research Disclosure (June 1984) Vol. 242, No. 24220 and No. 24230.

Typical cyan dye image-forming couplers are those phenol-type, naphthol-type four-equivalent and two-equivalent cyan dye image-forming couplers as described in, e.g., U.S. Pat. Nos. 2,306,410, 2,356,475, 2,362,598, 2,367,531, 2,369,929, 2,423,730, 2,474,239, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308, 3,839,044, British Pat. Nos. 478,991, 945,542, 1,084,480, 1,377,233, 1,388,024, 1,543,040, Japanese Patent O.P.I. Publication Nos. 37425/1972, 10135/1975, 25228/1975, 112038/1975, 117422/1975, 130441/1975, 6551/1976, 37647/1976, 52828/1976, 108841/1976, 109630/1978, 48237/1979, 66129/1979, 131931/1979, 32071/1980, and the like.

Further, the cyan coupler to be used in the silver halide emulsion of this invention is desirable to be one having the following Formula [IX] or [X]:

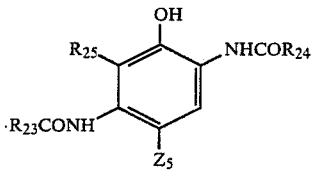

Formula [IX]

where $R_{23}$ is an alkyl or aryl group; $R^{24}$ is an alkyl, cycloalkyl, aryl or heterocyclic group; $R_{25}$ is a hydrgen atom, an alkyl or alkoxy group; provided that the $R_{25}$ and $R_{23}$ are allowed to combine with each other to form a ring; $Z_5$ is a hydrogen atom or a group that can split off by the reaction with the oxidized product of an aromatic primary amine-type color developing agent,

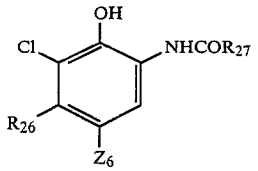

Formula [X]

wherein $R_{26}$ is a straight-chain or branched-chain alkyl group having from 1 to 4 carbon atoms; $R_{27}$ is a ballasting group; $Z_6$ is as defined in the $Z_5$ of Formula [IX]; and $R_{26}$ is a straight-chain or branched-chain alkyl group having preferably from 2 to 4 carbon atoms.

In the present invention, the alkyl group represented by the $R_{23}$ of Formula [IX] is a straight-chain or branched-chain alkyl group such as, e.g., a methyl group, ethyl group, isopropyl group, butyl group, pentyl group, octyl group, nonyl group, tridecyl group, or the like. The aryl group is, for example, a phenyl group, naphthyl group, or the like. These groups represented by $R_{23}$ may have a single substituent or a plurality of substituents. For example, typical substituents to be introduced to a phenyl group include halogen atoms (such as fluorine, chlorine, bromine, etc.), alkyl groups (such as methyl, ethyl, propyl, butyl, dodecyl, etc.), hydroxyl group, cyano group, nitro group, alkoxy groups (such as methoxy, ethoxy, etc.), alkylsulfonamido groups (such as methylsulfonamido, octylsulfonamido, etc.), arylsulfonamido groups (such as phenylsulfonamido, naphthylsulfonamido, etc.), alkylsulfamoyl groups (such as butylsulfamoyl, etc.), arylsulfamoyl groups (such as phenylsulfamoyl, etc.), alkyloxycarbonyl groups (such as methyloxycarbonyl, etc.), aryloxycarbonyl groups (such as phenyloxycarbonyl, etc.), aminosulfonamido groups (such as N,N-dimethylaminosulfonamido, etc.), acylamino groups, carbamoyl group, sulfonyl group, sulfinyl group, sulfoxy group, sulfo group, aryloxy groups, alkoxy groups, carboxyl group, alkylcarbonyl groups, arylcarbonyl groups, and the like. Two or more of these substituents may be introduced to a phenyl group.

The halogen atom represented by $R_{25}$ is, for example, a fluorine atom, chlorine atom, bromine atom, or the like. The alkyl group is, for example, a methyl group, ethyl group, butyl group, dodecyl group, or the like. The alkoxy group is, e.g., a methoxy group, ethoxy group, propyloxy group, butoxy group, or the like. The $R_{25}$ and $R_{23}$ may combine with each other to form a ring.

In the present invention, the alkyl group represented by the $R_{24}$ of Formula [IX] is, for example, a polyfluoroalkyl group, etc., substituted by a methyl, ethyl, butyl, hexyl, tridecyl, pentadecyl or heptadecyl group or a fluorine atom.

The aryl group represented by $R_{24}$ is, for example, a phenyl group or naphthyl group, and preferably a phenyl group. The heterocyclic group represented by $R_{24}$ is, e.g., a pyridyl group, furan group, or the like. The cycloalkyl group represented by $R_{24}$ is, e.g., a cyclopropyl group, cyclohexyl group, or the like. These groups represented by $R_{24}$ may have a single substituent or a plurality of substituents. For example, typical substituents introducible to a phenyl group include halogen atoms (such as fluorine, chlorine, bromine, etc.), alkyl groups (such as methyl, ethyl, propyl, butyl, dodecyl, etc.), hydroxyl group, cyano group, nitro group, alkoxy groups (such as methoxy, ethoxy, etc.), alkylsulfonamido groups (such as methylsulfonamido, octylsulfonamido, etc.), arylsulfonamido groups (such as phenylsulfonamido, naphthylsulfonamido, etc.), alkylsulfamoyl groups (such as butylsulfamoyl, etc.), arylsulfamoyl groups (such as phenylsulfamoyl, etc.), alkyloxycarbonyl groups (such as methyloxycarbonyl, etc.), aryloxycarbonyl groups (such as phenyloxycarbonyl, etc.), aminosulfonamido group, acylamino groups, carbamoyl group, sulfonyl group, sulfinyl group, sulfoxy group, sulfo group, aryloxy groups, alkoxy groups, carboxyl group, alkylcarbonyl groups, arylcarbonyl groups, and the like. Two or more of these groups may be introduced to a phenyl group. The preferred group represented by $R_{24}$ is a polyfluoroalkyl group, phenyl group or phenyl group having one or not less than two substituents which include halogen atoms, alkyl groups, alkoxy groups, alkylsulfonamido groups, arylsulfonamido groups, alkylsulfamoyl groups, arylsulfamoyl groups, alkylsulfonyl groups, arylsulfonyl groups, alkylcarbonyl groups, arylcarbonyl groups, and cyano group.

In the present invention, the straight-chain or branched-chain alkyl group having from 1 to 4 carbon atoms represented by the $R_{26}$ of Formula [X] is, for example, an ethyl group, propyl group, butyl group, iso-propyl group, iso-butyl group, sec-butyl group or tert-butyl group. These groups each may have a substituent. The substituent includes acylamino groups (such as acetylamino, etc.), alkoxy groups (such as methoxy, etc.), and the like. However, the $R_{26}$ is desirable to be nonsubstituted.

The ballasting group represented by the $R_{27}$ of Formula [X] is an organic group having such a magnitude and form as to provide coupler molecules with a bulkiness enough to make the coupler substantially unable to diffuse from the coupler-containing layer into other layers.

Typical ballasting groups are those alkyl or aryl groups having from 8 to 32 carbon atoms.

These alkyl or aryl groups each may have a substituent. The substituent to the aryl group includes, e.g., alkyl groups, aryl groups, alkoxy groups, aryloxy groups, carboxy group, acyl groups, ester groups, hydroxy group, cyano group, nitro group, carbamoyl group, carbamido group, alkylthio groups, arylthio groups, sulfonyl group, sulfonamido group, sulfamoyl group, halogent atoms, and the like. And the substituent to the alkyl group includes the same substituents as those enumerated above except the alkyl groups.

The particularly preferred ones as the ballasting group are those having the following Formula [XI]:

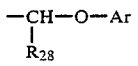

Formula [XI]

wherein $R_{28}$ is a hydrogen atom or an alkyl group having from 1 to 18 carbon atoms; Ar is an aryl group, allowed to have a substituent. The substituent includes alkyl groups, hydroxy group, alkylsulfonamido groups and the like. The most preferred one is a branched-chain alkyl group such as a t-butyl group.

The group represented by each of the $Z_5$ and $Z_6$ of Formulas [IX] and [X], respectively, which can split off as a result of the reaction with the oxidized product of an aromatic primary amine-type color developing agent, is one well known to those skilled in the art, and acts advantageously by reforming the reactivity of the coupler and by splitting from the coupler to carry out functions such as development inhibition, bleach inhibition, color correction, and the like.

Typical examples of the above group include, e.g., halogen atoms such as chlorine, fluorine, etc., and substituted or unsubstituted alkoxy, aryloxy, arylthio, carbamoyloxy, acyloxy, sulfamoyloxy, sulfonamido, heteroylthio and heteroyloxy groups. The particularly preferred one of these examples represented by $Z_5$ or $Z_6$ is a hydrogen atom or chlorine atom.

Further detailed descriptions about the above are found in Japanese Patent O.P.I. Publication Nos. 10135/1975, 120334/1975, 130441/1975, 48237/1979, 146828/1976, 14736/1979, 37425/1972, 123341/1975, 95346/1983, Japanese Patent Examined Publication No. 36894/1973, U.S. Pat. Nos. 3,476,563, 3,737,316, and 3,227,551.

The following are typical examples of those cyan couplers having Formula [IX]:

C-1

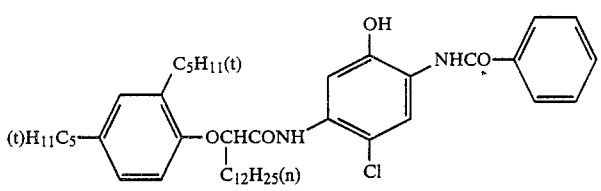

C-2

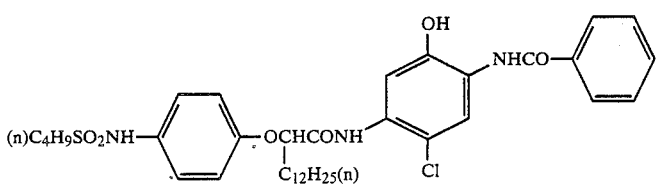

C-3

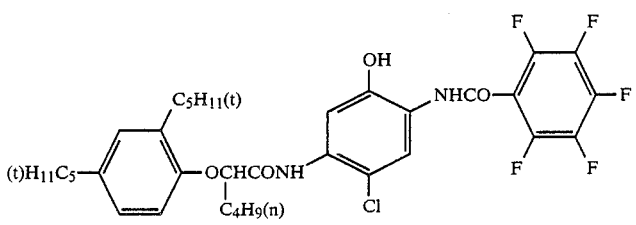

C-4

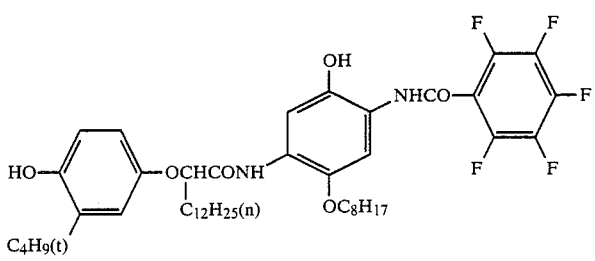

C-5

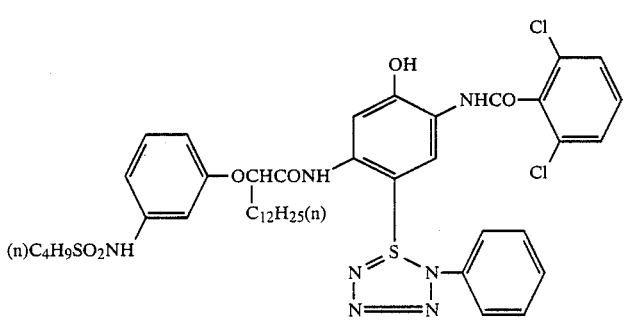

-continued
C-6
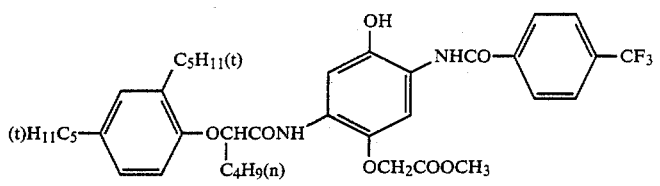
C-7
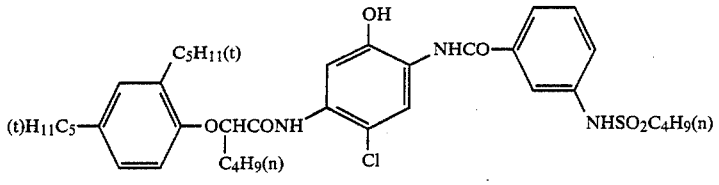
C-8
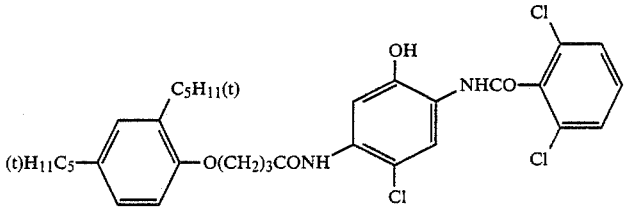
C-9
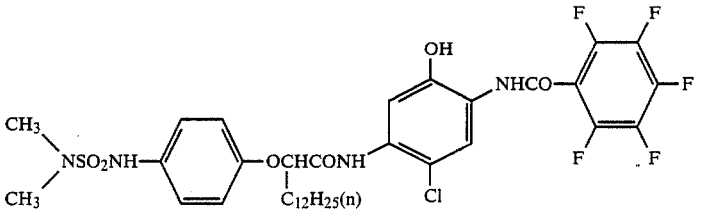
C-10
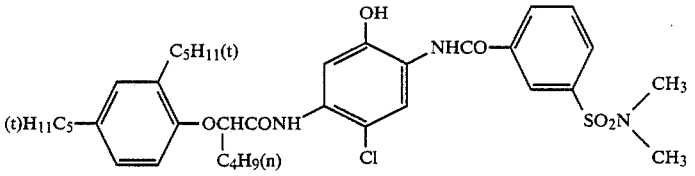
C-11
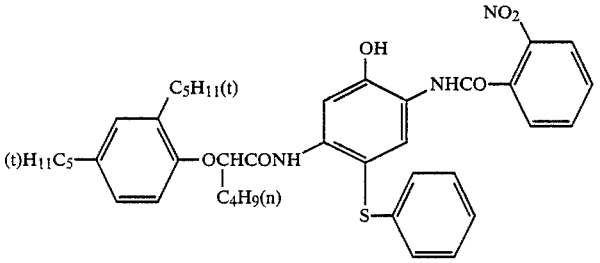
C-12
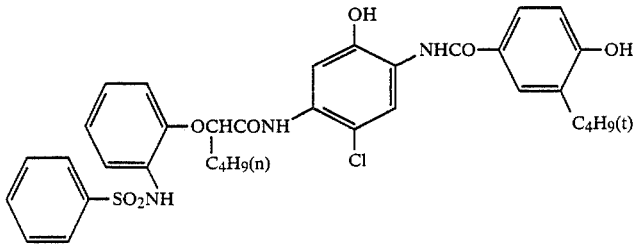

-continued
C-13
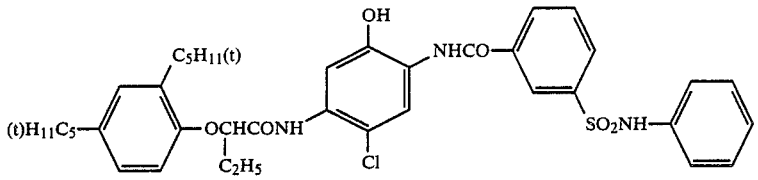
C-14
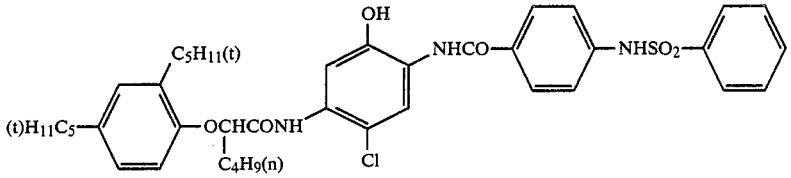
C-15
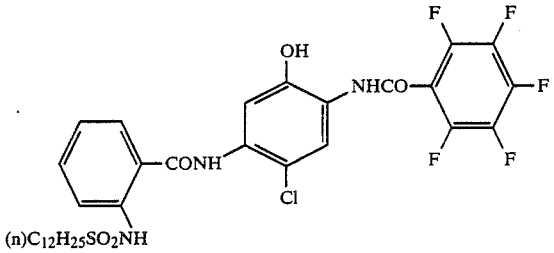
C-16
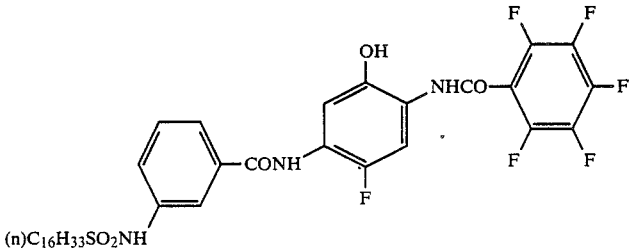
C-17
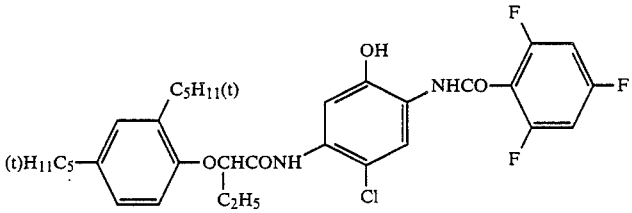
C-18
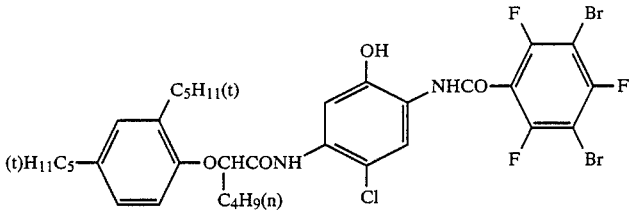
C-19
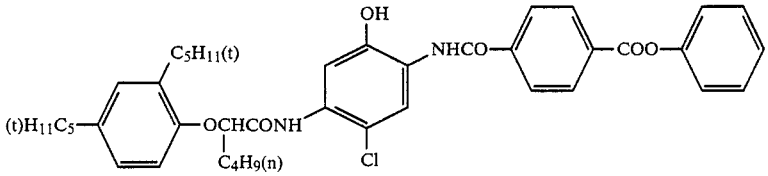

-continued
C-20
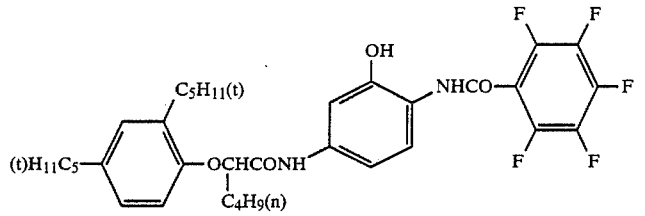
C-21
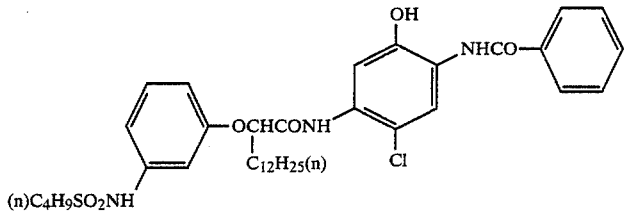
C-22
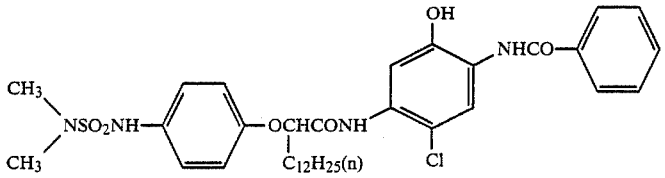
C-23
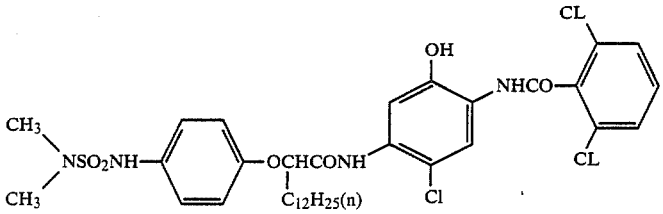
C-24
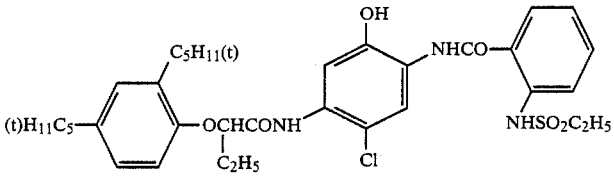
C-25
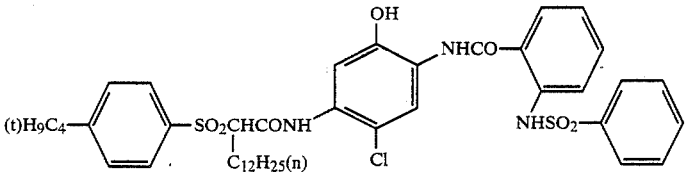
C-26
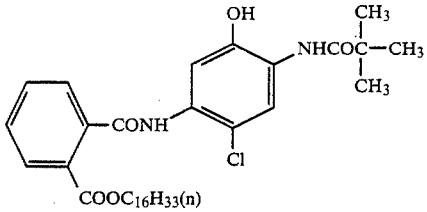
C-27
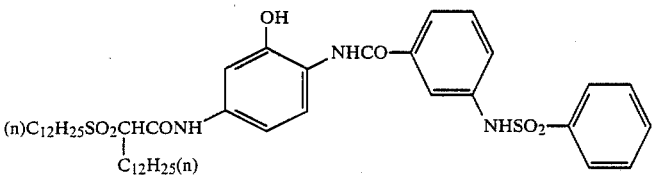

-continued
C-28
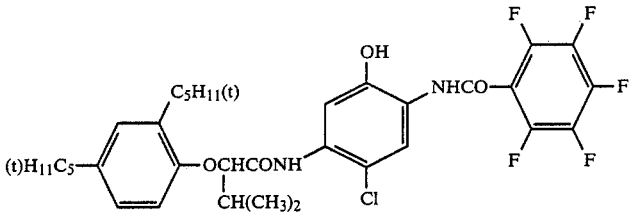
C-29
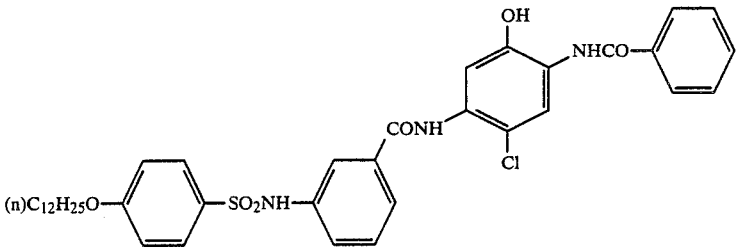
C-30
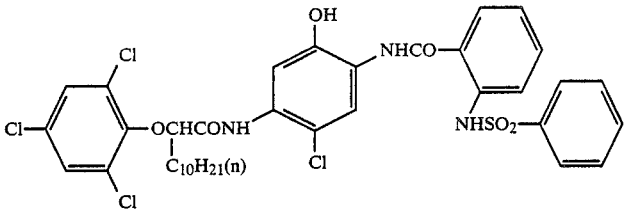
C-31
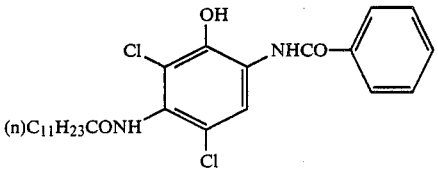
The following are examples of those couplers having Formula [X]:
Formula [X]
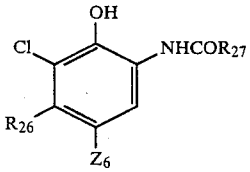
| Coupler No. | $R_{26}$ | $Z_6$ | $R_{27}$ |
|---|---|---|---|
| C-32 | $-C_2H_5$ | $-Cl$ | 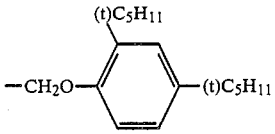 |
| C-33 | $-C_2H_5$ | 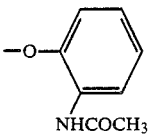 | 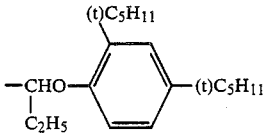 |

-continued
Formula [X]
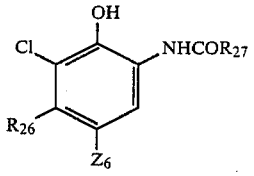
| Coupler No. | $R_{26}$ | $Z_6$ | $R_{27}$ |
|---|---|---|---|
| C-34 | $-CH(CH_3)_2$ | $-Cl$ | $-CH(C_2H_5)O-C_6H_4-C_{15}H_{31}$ |
| C-35 | $-C_2H_5$ | $-Cl$ | $-CH(C_2H_5)O-C_6H_3(t)C_5H_{11}-(t)C_5H_{11}$ |
| C-36 | $-C_2H_5$ | $-Cl$ | $-CH(C_4H_9)O-C_6H_3(t)C_5H_{11}-(t)C_5H_{11}$ |
| C-37 | $-C_4H_9$ | $-F$ | $-CH(C_2H_5)O-C_6H_3(t)C_5H_{11}-(t)C_5H_{11}$ |
| C-38 | $-C_2H_5$ | $-F$ | $-CH(C_{12}H_{25})O-C_6H_3-OH-(t)C_4H_9$ |
| C-39 | $-C_2H_5$ | $-Cl$ | $-(CH_2)_3O-C_6H_3(t)C_5H_{11}-(t)C_5H_{11}$ |
| C-40 | $-C_2H_5$ | $-F$ | $-CH_2O-C_6H_3(t)C_5H_{11}-(t)C_5H_{11}$ |
| C-41 | $-CH_3$ | $-Cl$ | $-CH_2O-C_6H_3(t)C_5H_{11}-(t)C_5H_{11}$ |
| C-42 | $-C_2H_5$ | $-Cl$ | $-CH(C_{12}H_{25})O-C_6H_4-NHSO_2C_4H_9$ |

-continued

Formula [X]

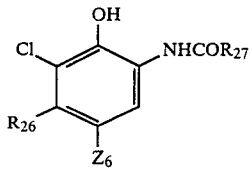

| Coupler No. | $R_{26}$ | $Z_6$ | $R_{27}$ |
|---|---|---|---|
| C-43 | $-C_2H_5$ | $-Cl$ | 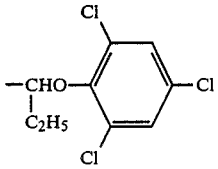 |
| C-44 | $-CH(CH_3)_2$ | $-Cl$ | $-C_{18}H_{37}$ |
| C-45 | $-C_2H_5$ | $-F$ | 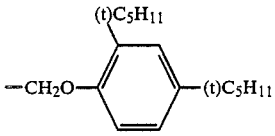 |
| C-46 | $-CH_3$ | $-Cl$ | 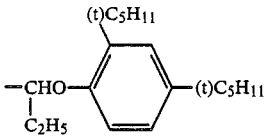 |
| C-47 | $-C_2H_5$ | $-Cl$ | 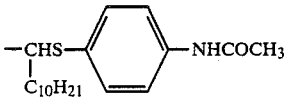 |
| C-48 | $-C_3H_7$ | $-Cl$ | 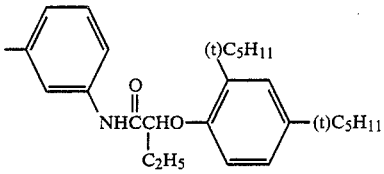 |
| C-49 | $-C_3H_7$ | $-Cl$ | 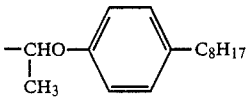 |
| C-50 | $-C_2H_4NHC(=O)CH_3$ | $-Cl$ | 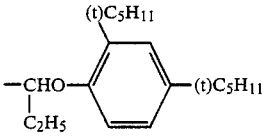 |
| C-51 | $-C_3H_6OCH_3$ | $-Cl$ | 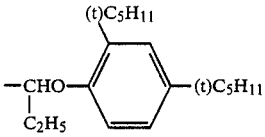 |

In the present invention, benzophenone-type or benzotriazole-type compounds may be used as the ultraviolet absorbing agent.

Those benzotriazole-type compounds are described in Japanese Patent Examined Publication Nos. 10466/1961, 26187/1967, 5496/1973, 41572/1973, U.S. Pat. Nos. 3,754,919, 4,220,711, and the like.

These cyan dye-forming couplers, magenta dye-forming couplers, yellow dye-forming couplers and ultraviolet absorbing agents, which all are hydrophobic photographic additives, may be dispersed into an aqueous hydrophilic binder solution by a conventionally known method, and the dispersed liquid is then incorporated into silver halide emulsion layers or nonlight-sensitive layers. As the method for dispersing these hydrophobic compounds any of those latex-dispersing methods or oil-in-water-type dispersing methods as described in Japanese Patent O.P.I. Publication Nos. 74538/1974, 59943/1976, Research Disclosure No. 14850 (August 1976), pp. 77–79, and the like, may be used. As the oil-in-water-type dispersing method those conventionally known methods for dispersing hydrophobic compounds such as couplers may be applied. To be concrete, such a hydrophobic compound is dissolved into a mixture of a high-boiling organic solvent whose boiling point is not less than 175° C. and a low-boiling solvent such as ethyl acetate, butyl acetate, etc., which is added at need thereto, and the solution is then mixed into an aqueous solution containing a surface active agent and hydrophilic binder such as gelatin, and emulsifiedly dispersed by dispersing means such as a high-speed rotary mixer, colloid mill, ultrasonic disperser, etc., and then the dispersed liquid is incorporated into emulsion layers or hydrophobic colloid layers as subsidiary layers.

As for the binder of the component layers of the light-sensitive material of this invention, gelatin such as an alkali-treated gelatin or acid-treated gelatin is most generally used, and also such gelatin may be used in part along with a derivative gelatin such as phthalated gelatin, phenylcarbamoyl gelatin, etc., or albumin, agar-agar, gum arabic, alginic acid, partly hydrolized cellulose derivative, partially hydrolized polyvinyl acetate, polyacrylamide, polyvinyl alcohol, or the like, or copolymer of these vinyl compounds.

The emulsion and subsidiary layers of the light-sensitive material of this invention may contain various photographic additives. For example, those antifoggants, dye image discoloration-preventing agents, anti-color stain agents, brightening agents, antistatic agents, surface active agents, ultraviolet-absorbing agents as described in Research Disclosure No. 17643 may be arbitrarily used.

The light-sensitive material of this invention is prepared by coating component layers such as emulsion and subsidiary layers containing as needed various photographic additives mentioned above through a subbing layer or interlayer on a support or directly on a corona discharge-treated, flame-treated or ultraviolet ray-treated support. Those advantageously usable as the support include, e.g., baryta paper, polyethylene-laminated paper, polypropylene synthetic paper, reflective layer- or reflective material-combinedly used transparent support materials such as glass plates, polyester films including cellulose acetate film, cellulose nitrate film, polyethylene terephthalate film, etc., polyamide film, polycarbonate film, polystyrene film, and the like.

The coating of emulsion layers and other component layers used in this invention may be carried out by any of various coating methods including the dipping coating method, air-doctor coating method, curtain coating method, hopper coating method, and the like. Further, those methods for simultaneously coating two or more layers as described in U.S. Pat. Nos. 2,761,791 and 2,941,898 may also be used.

In the present invention, the coating position of each emulsion layer may be discretionally settled. For example, the emulsion layers may be coated in the order of a blue-sensitive emulsion layer, green-sensitive emulsion layer and red-sensitive emulsion layer from the support side, or alternatively in the order of a red-sensitive emulsion layer, green-sensitive emulsion layer and blue-sensitive emulsion layer from the support side.

To be more concrete, in the case of a color photographic paper, seven layers composed of a blue-sensitive emulsion layer, first interlayer, green-sensitive emulsion layer, second interlayer, red-sensitive emulsion layer, third interlayer, and protective layer are preferred to be coated in the described order from the support side. The above second interlayer and/or third interlayer are desirable to contain an ultraviolet-absorbing agent.

These component layers may contain the foregoing hydrophilic colloid as the binder material for emulsion use, and may also contain the foregoing various photographic additives to be incorporated in the emulsion layers.

In the case where the present invention is applied to a color photographic light-sensitive material for making prints, the light-sensitive material is exposed through a negative film having an image composed of dyes as the coupling reaction products, and then color-developed.

The color development is carried out by an ordinary color developing method.

That is, the exposed light-sensitive material is first processed in a color developer solution containing a color developing agent. Alternatively, where the light-sensitive material contains a color developing agent or the precursor thereof, the light-sensitive material is processed in an activator solution.

And the color development is then followed by bleach and fixation processes in usual manner.

In this instance, there are cases where the color developing process by the color developer or activator solution, the bleach process and the fixation process are performed independently, but, instead, these different processes can also be carried out at a time by a single processing liquid (monobath) having the functions of these processes; for example, a color developer solution or activator solution containing a bleaching agent and fixing agent together that will be described hereinafter; a bleach-fix bath containing bleaching agent and fixing agent for use in the bleaching and fixing following the color developing process; and the like.

The light-sensitive material may be processed din a bleach-fix bath or the like to be desilvered immediately after being processed in a color developer solution or activator solution, but may, after the color development, be processed in an acid stop bath before the bleaching and fixing processes. In such an acid stop bath an aqueous acetic acid or citric acid solution may be used. Also, such processes as prehardening, neutralizing, washing, stabilizing processes and the like may, if necessary, be provided.

The color photographic light-sensitive material for making prints, by being processed in such color developing processes, has a dye image formed by the coupling reaction.

In addition, those typically usable as the color developing agent for developing the light-sensitive material of this invention are aromatic primary amine color developing agents, which include aminophenol-type and p-phenylenediamine-type derivatives. These compounds may be used in a free state or in the form of a salt thereof such as the hydrochloride, sulfate, p-toluenesulfonate, tetraphenyl-borate, p-(t-octyl)benzenesulfonate thereof or the like.

Typical examples of such aromatic primary amine color developing agents include N,N-diethyl-p-phenylenediamine hydrochloride, N-methyl-p-phenylenediamine hydrochloride, N,N-dimethyl-p-phenylenediamine hydrochloride, N-ethyl-N-β-methanesulfonaminoethyl-3-methyl-4-aminoaniline and the sulfate thereof, N-ethyl-N-β-hydroxyethylaminoaniline, N,N-diethyl-3-(β-methanesulfonamidoethyl)-4-aminoaniline hydrochloride, 4-amino-N-(2-methoxyethyl)-N-ethyl-3-methylaniline-p-toluene sulfonate, N-ethyl-N-β-methanesulfonamidoethyl-3-methyl-4-aminoaniline tetraphenylborate, 4-amino-N-(2-methoxyethyl)-N-ethyl-3-methylaniline tetraphenylborate, p-morpholinoaniline, p-piperidinoaniline, 4-amino-N,N-diethyl-3-chloroaniline, and the like.

Further, if necessary, the light-sensitive material of this invention may contain a color developing agent precursor. The color developing agent precursor is a compound that is capable of producing a color developing agent under an alkaline condition, and includes aromatic aldehyde derivative-Schiff's basetype precursor, polyvalent metallic ion complex precursor, phthalic acid imide derivative precursor, phosphoric acid amide derivatic precursor, sugar-amine reaction product precursor and urethane-type precursor. Those aromatic primary amine-type color developing agent precursors are described in, e.g., U.S. Pat. Nos. 3,342,599, 2,507,114, 2,695,234 and 3,719,492, British Pat. No. 803,783, Japanese Patent O.P.I. Publication Nos. 135628/1978 and 79035/1979, Research Disclosure Nos. 15159, 12146 and 13924.

Any of these aromatic primary amine-type color developing agents is contained in a quantity of normally from about 1 to about 20 g/liter in a color developer solution. If this is to be contained in the form of a precursor in the light-sensitive material, it is used in a quantity of from about 0.5 to about 3 moles per mole of silver halide.

The color developer or activator solution to be used for developing the light-sensitive material of this invention contains an alkaline agent such as potassium hydroxide, sodium hydroxide, sodium carbonate, potassium carbonate, sodium tertiary phosphate, potassium tertiary phosphate or the like; a sulfide such as sodium sulfide or potassium sulfide; and a bromide such as sodium bromide, potassium bromide, ammonium bromide, or the like. Further, if necessary, the solution may also contain a prior-art development restrainer; a chloride such as ammonium chloride, potassium chloride, sodium chloride, or the like; an organic solvent such as ethylene glycol, diethylene glycol, methanol, ethanol, n-butanol, benzyl alcohol, acetone, dimethylformamide, or the like; an amine such as hydroxylamine, ethanolamine, ethylenediamine, diethanolamine, or the like; and a water softener such as sodium hexametaphosphate, sodium tripolyphosphate, ethylenediamine-tetraacetic acid, ethylenetriamine-pentaacetic acid, or the like.

The color developer or activator solution to be used in this invention may contain a subsidiary developing agent, which is preferably a 1-aryl-3-pyrazolidone derivative and used in the quantity range of from 1 mg to 1 gram, and preferably from 10 mg to 500 mg per liter of the color developer or activator solution. Those typically usable as the subsidiary developing agent include 1-phenyl-3-pyrazolidone, 4-methyl-1-phenyl-3-pyrazolidone, 4,4-dimethyl-1-phenyl-3-pyrazolidone, 4-methyl-4-hydroxymethyl-1-phenyl-3-pyrazolidone, 4-methyl-4-hydroxymethyl-1-(p-tolyl)-3-pyrazolidone, and the like.

The color developer or activator solution to be used in this invention is always maintained alkaline in the usual manner, and the hydrogen ion concentration thereof, although arbitrarily selectable according to the type, composition, purpose and use of a negative light-sensitive material and color photographic light-sensitive material for making prints therefrom to be used in this invention, is generally from pH9.5 to pH13.5.

The color developer or activator solution is used generally in a certain temperature range, which, although selectable according to the type, composition, use and purpose of the photographic light-sensitive material used in this invention, is preferably from 15° C. to 70° C., and more preferably from 30° C. to 50° C.

As for the bleaching agent to be used in a bleaching bath or bleach-fix bath, prior-art compounds may be used which include, e.g., aminopolycarboxylic acid ferric complex salts such as ferric-sodium ethylenediamine-tetraacetate, ferric-ammonium ethylenediamine-tetraacetate, etc., and persulfates such as ammonium persulfate, sodium persulfate, etc. For the fixing bath or bleach-fix bath those prior-art compounds may be used as the fixing agent, which include thiosulfates such as sodium thiosulfate, ammonium thiosulfate; water-soluble sulfur-containing diols such as 3,6-dithia-1,8-octanediol, 3,6,9,12-tetrathia-1,14-tetradecanediol; water-soluble sulfur-containing dibasic acids such as ethylene-bis-thioglycolic acid, sodium ethylene-bis-thioglycolate; and the like.

Effect of the Invention

The present invention, when applied particularly to a color photographic light-sensitive material for print-making use, can provide a light-sensitive material which is excellent in the physical characteristics of the layers thereof; i.e., excellent in the characteristics such as the glossiness, scratch resistance, degree of swelling, etc., and whose sensitivity changes very little with time after the manufacture thereof, thus enabling to largely improve the work efficiency in the photofinishing process.

EXAMPLES OF THE INVENTION

The present invention will be illustrated further in detail by the following examples. The invention, however, is not limited to and by the examples.

EXAMPLE-1

A chemically ripened silver chlorobromide emulsion (containing 80 mole% silver bromide), to which is added a $2.0\times10^{-5}$ mole per mole of silver halide of the foregoing exemplified compound D-22 as a sensitizing dye, is prepared.

On the other hand, the foregoing exemplified Coupler C-28 is dissolved into a mixture of dioctyl phthalate with ethyl acetate; the solution is then added to an aqueous gelatin solution containing Alkanol XC (sodium alkylnaphthalenesulfonate, a product of DuPont); and the mixture is then dispersed by a homogenizer to thereby prepare a coupler-dispersed liquid.

Subsequently, this coupler-dispersed liquid is added to the above chemically ripened silver halide emulsion so that the former is contained in a quantity of 0.4 mole per mole of silver halide, and further to this is added a $8\times10^{-3}$ mole per mole of silver halide of each of the foregoing invention's compounds X-26, X-30 and X-37 separately to make different samples in combination as shown in Table 1, and further to these were added the foregoing exemplified hardener compounds II-1, II-2 and III-1 and the following comparative hardener H-1 as shown in Table 1, and then dried, whereby monochromatic photographic element samples No. 1 through No. 8 are prepared.

Comparative hardener:

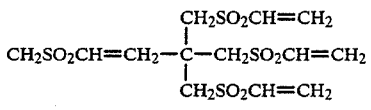

The processing conditions used herein are as follows, and applied in the same way to all the samples.

| Processing (at 32.8° C.) | Processing time |
|---|---|
| Color development | 3 min. & 30 sec. |
| Bleach-fix | 1 min. & 30 sec. |
| Washing | 3 min. & 30 sec. |
| Drying | |

Color developer composition

| | |
|---|---|
| N—ethyl-N—β-methanesulfonamidoethyl-3-methyl-4-aminoaniline sulfate | 4.0 g |
| Hydroxylamine sulfate | 2.0 g |
| Potassium carbonate | 25.0 g |
| Sodium chloride | 0.1 g |
| Sodium bromide | 0.2 g |
| Anhydrous sodium sulfite | 2.0 g |
| Benzyl alcohol | 10.0 g |
| Polyethylene glycol (average degree of polymerization 400) | 3.0 ml |
| Water to make 1 liter; use sodium hydroxide to adjust the pH to 10.0. | |

Bleach-fix bath composition

| | |
|---|---|
| Iron-sodium ethylenediamine-tetraacetate | 60.0 g |
| Ammonium thiosulfate | 100.0 g |
| Sodium hydrogensulfite | 20.0 g |
| Sodium metabisulfite | 5.0 g |
| Water to make 1 liter; use sulfuric acid to adjust the pH to 7.0. | |
| Oxidation-reduction potential: −70 mV | |

The thus prepared samples No. 1 through No. 8 each was examined with respect to the glossiness, scratch resistance and raw-stock preservability (change in the sensitivity with time after the preparation of each sample) in the following procedure. The results are as shown in Table 1.

Glossiness:

A white sample obtained by processing each of the unexposed samples by the above procedure was measured with respect to the glossiness by use of a glossmeter (manufactured by Tokyo Denshiki K.K.), and also measured with respect to the glossiness of the layer when deteriorated by being exposed over a period of 300 hours to the xenon light of a xenon fadeometer.

Scratch resistance:

At a point of time nearing the completion of the color-development of each sample, i.e., after immersing the sample for three minutes in the foregoing color developer solution, the sample was measured with respect to the scratch resistance by use of a scrachmeter (manufactured by Hayden).

Raw-stock preservability:

Each sample was allowed to stand for a period of one month in an atmospheric condition of 25° C./60% relative humidity, and then the change in the sensitivity, i.e., the difference between the sensitivity values before and after the raw-stock storage, was determined on the basis of the following formula. The sensitivity was found by measuring the densities of each sample piece that was exposed through an optical wedge and then processed by the foregoing developing procedure.

$$\text{Density change during storage (\%)} = \frac{\text{After-storage sensitivity} - \text{Before-storage sensitivity}}{\text{Before-storage sensitivity}} \times 100$$

TABLE 1

| | Composition | | Results | | | | |
|---|---|---|---|---|---|---|---|
| | | | Glossiness | | | | |
| Sample No. | Hardener (g per g of gelatin) | Formula[I] compound | Right after processing | After xenon exp. | Scratch resistance (g) | Raw-stock preservability (%) | Remarks |
| 1 | H-1 (0.02) | None | 91 | 83 | 24 | −8% | Comparative |
| 2 | H-1 (0.02) | X-26 | 92 | 84 | 26 | −7% | " |
| 3 | II-1 (0.01) | None | 94 | 90 | 48 | −24% | " |
| 4 | II-1 (0.01) | X-26 | 93 | 90 | 47 | −3% | Invention |
| 5 | II-2 (0.02) | X-26 | 94 | 91 | 49 | −4% | " |
| 6 | III-1 (0.02) | X-26 | 94 | 91 | 47 | −3% | " |
| 7 | II-1 (0.01) | X-30 | 93 | 90 | 48 | −4% | " |
| 8 | II-1 (0.01) | X-37 | 94 | 90 | 47 | −6% | " |

As is apparent from Table 1, samples No. 2 through No. 8, which use the hardeners of this invention, are excellent in the glossiness as well as in the scratch resistance as compared to comparative sample No. 1. Further, as for the change in the sensitivity with the lapse of time, where the hardeners of this invention are used, samples No. 4 through No. 8, containing the compounds of Formula [I] of this invention, are largely improved as compared to sample No. 3, containing none of such compounds.

EXAMPLE-2

Samples were prepared in the same manner as in Example-1 except that a protective layer (gelatin-coated amount: 1.5 g/m$^2$) was provided as the topmost layer; and the hardeners II-1, II-2 and III-1 and the comparative hardener H-1 and the invention compounds X-26, X-30 and X-37 in the same quantities as used in Example-1 were added not to the emulsion layer but to the protective layer coating liquid. The obtained samples were tested in the same manner as in Example-1. The results were similar to those of Example-1.

EXAMPLE-3

Separate chemically-ripened silver chlorobromide emulsions containing the foregoing exemplified sensitizing dye compounds D-3 and D-32 and the following sensitizing dyes A and B, respectively, each in a quantity of $5\times10^{-5}$ mole per mole of silver halide, are prepared.

On the other hand, a coupler-dispersed liquid containing the foregoing exemplified coupler C-35 is prepared in the same manner as in Example-1, and the liquid is added separately to the above respective chemically-ripened silver halide emulsions so that the coupler content is 0.4 mole per mole of silver halide, and then the coupler-containing emulsions each is coated on a polyethylene-coated paper. Further, on the layer of each of these coated samples is coated a protective layer comprising the invention's hardener II-1 added in a quantity of 0.01 g per gram of gelatin (total gelatin of both emulsion layer and protective layer) and the invention's compound X-26, in combination as shown in Table 1, added in a quantity of $8\times10^{-3}$ mole per mole of silver halide, and then dried, whereby monochromatic photographic element samples No. 9 through No. 16 are prepared.

These samples each was tested with respect to the raw-stock preservability in the same manner as in Example-1. The test results are as given in Table 2.

As is apparent from Table 2, any of the light-sensitive material samples Nos. 10, 12, 14 and 16 of this invention shows that the degree of the change in the sensitivity thereof during the raw-stock storage is less than one second of that of any of the comparative samples, and further this effect is particularly conspicuous in the samples No. 14 and No. 16, which contain the particularly preferred sensitizing dyes of this invention earlier mentioned in this specification.

EXAMPLE-4

On a polyethylene-coated paper support are coated the component layers in the order given in Table 3 from the support side in combination with the invention's hardeners, comparative hardeners, invention's compounds, sensitizing dyes and cyan couplers as given in Table 4, whereby multicolor photographic element samples No. 19 through No. 35 are prepared. The obtained samples were subjected to various tests in the following procedures.

In addition, the yellow coupler Y-1, magenta coupler M-1, ultraviolet-absorbing agents UV-1 and UV-2, antidiscoloration agents AO-1 and AO-2, sensitizing dye H-1, antistain agent AS-1 and comparative hardener H-2, which all are used in this example, are as follows:

Sensitizing dye A

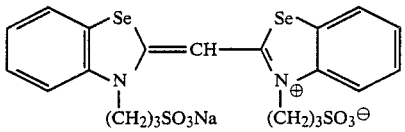

Sensitizing dye B

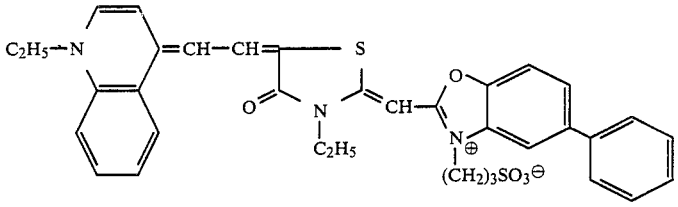

TABLE 2

| Sample No. | Composition: Sensitizing dye | Coupler | Hardener | Formula[I] compound | Result: Raw-stock preservability (%) | Remarks |
|---|---|---|---|---|---|---|
| 9 | A | C-35 | II-1 | None | 17% | Comparative |
| 10 | A | " | X-26 | 9% | Invention | |
| 11 | B | " | None | −29% | Comparative | |
| 12 | B | " | X-26 | 15% | Invention | |
| 13 | D-3 | " | None | −26% | Comparative | |
| 14 | D-3 | " | X-26 | −4% | Invention | |
| 15 | D-32 | " | None | −25% | Comparative | |
| 16 | D-32 | " | X-26 | −3% | Invention | |

Yellow coupler Y-1

-continued

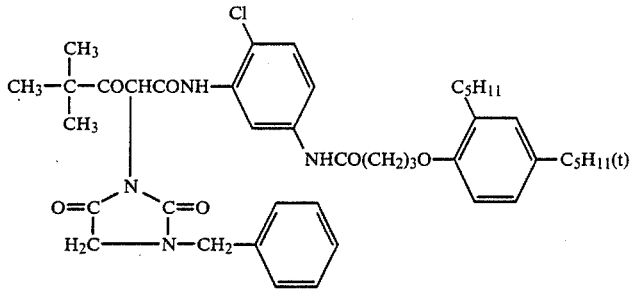

Magenta coupler M-1

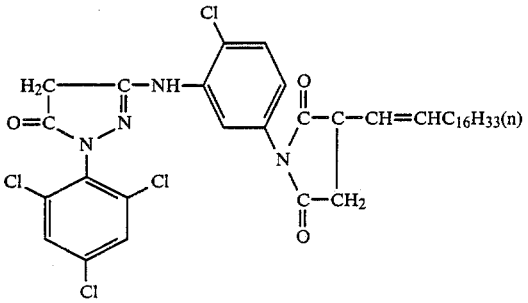

Ultraviolet-absorbing agent UV-1

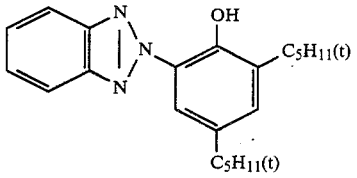

Ultraviolet-absorbing agent UV-2

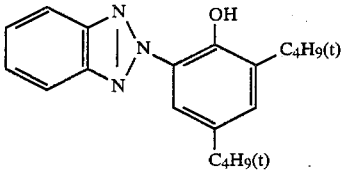

Antidiscoloration agent AO-1

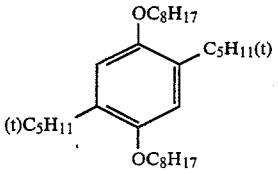

Antidiscoloration agent AO-2

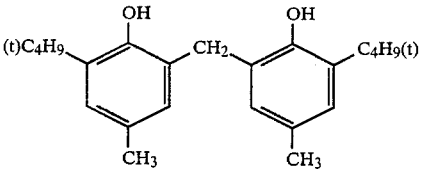

Sensitizing dye H

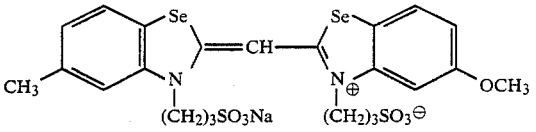

Sensitizing dye I

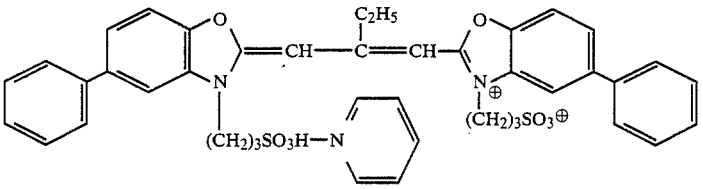

Antistain agent AS-1

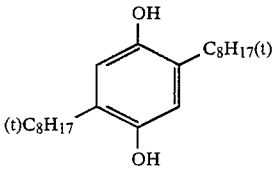

Comparative hardener H-2

1,3,5-triacryloyl-hexahydro-S—triazine

Glossiness:

Tested in the same manner under the same condition as in Example-1.

Scratch resistance:

Tested in the same manner under the same condition as in Example-1.

Raw-stock preservability:

Tested in the same manner under the same condition as in Example-1.

Degree of swelling:

Each sample was allowed to stand for two days and five days in an incubation chamber constantly air-conditioned at 35° C./50%RH, and after that the degree of swelling thereof was measured and determined by the following formula:

Degree of swelling (%) =

$$\frac{\text{Layer thickness when immersed in color developer liquid at 33° C.}}{\text{Dry thickness}} \times 100$$

The results are as shown in Table 4.

TABLE 3

| Layer | Composition |
|---|---|
| Seventh layer (protective layer | Gelatin (1.5 g/m$^2$), hardener (see Table 4 for the type and adding quantity) |
| Sixth layer (third interlayer | Gelatin (1.5 g/m$^2$), ultraviolet-absorbing agents UV-1 (0.2 g/m$^2$) and UV-2 (0.2 g/m$^2$), antistain agent AS-1 (0.02 g/m$^2$), high-boiling solvent dioctyl phthalate (0.2 g/m$^2$) |
| Fifth layer (red-sensitive layer) | Gelatin (2.0 g/m$^2$), silver chlorobromide emulsion [containing 80 mole % AgBr] (0.25 g/$^2$), cyan coupler [Table 4] AS-1 (0.4 mole per mole of silver halide), antistain agent (0.01 g/m$^2$), high-boiling solvent dioctyl phthalate (0.2 g/m$^2$), sensitizing dye [Table 4] (2.0 × 10$^{-5}$ mole per mole of silver halide), compound of Formula[I] [Table 4] (8 × 10$^{-3}$ mole per mole of silver halide) |
| Fourth layer (second interlayer) | Gelatin (1.5 g/m$^2$), ultraviolet-absorbing agents UV-1 (0.3 g/m$^2$) and UV-2 (0.3 g/m$^2$), antistain agent AS-1 (0.03 g/m$^2$), high-boiling solvent dioctyl phthalate (0.3 g/m$^2$) |
| Third layer (green-sensitive layer) | Gelatin (2.0 g/m$^2$), silver chlorobromide emulsion [containing 80 mole % AgBr] (0.35 g/m$^2$), magenta coupler M-1 (0.4 g/m$^2$), antistain agent AS-1 (0.01 g/m$^2$), antidiscoloration agents AO-1 (0.2 g/m$^2$) and AO-2 (0.1 g/m$^2$), high-boiling solvent dioctyl phthalate (0.25 g/m$^2$), sensitizing dye I (1.5 × 10$^{-4}$ mole per mole of silver halide) |
| Second layer (first interlayer) | Gelatin (1.0 g/m$^2$), antistain agent AS-1 (0.07 g/m$^2$), high-boiling solvent diisodecyl phthalate (0.04 g/m$^2$) |
| First layer (blue-sensitive layer) | Gelatin (2.0 g/m$^2$), silver chlorobromide emulsion [containing 90 mole % AgBr] (0.3 g/m$^2$), yellow coupler Y-1 (0.8 g/m$^2$), antistain agent AS-1 (0.02 g/m$^2$), high-boiling solvent dinonyl phthalate (0.3 g/m$^2$), sensitizing dye H (2 × 10$^{-4}$ mole per mole of silver halide) |
| Support | Polyethylene-coated paper |

Note: These given in the above parentheses are coating quantities or adding quantities.

TABLE 4

| | Composition | | | | Results | | | | | | |
|---|---|---|---|---|---|---|---|---|---|---|---|
| | | | | | Glossiness | | | Degree of swelling (%) | | | |
| Sample No. | Hardener (g per g of gelatin | Formula [I] compound | Red-sensitizing dye | Cyan coupler | Right after processing | After xenon exp. | Scratch Resistance (%) | two days | five days | Raw-stock preservability (%) | Remarks |
| 19 | H-1 (0.02) | None | D-21 | C-28 | 91 | 83 | 26 | 354 | 317 | −8% | Comparative |
| 20 | H-2 (0.02) | None | " | " | 92 | 88 | 48 | 581 | 327 | −9% | " |
| 21 | II-1 (0.01) | None | " | " | 93 | 91 | 49 | 320 | 316 | −26% | " |
| 22 | II-2 (0.02) | None | " | " | 94 | 92 | 50 | 325 | 319 | −25% | " |
| 23 | III-2 (0.02) | None | " | " | 93 | 92 | 48 | 322 | 315 | −28% | " |
| 24 | H-1 (0.02) | X-26 | " | " | 89 | 81 | 27 | 349 | 318 | −6% | " |
| 25 | H-2 (0.02) | X-26 | " | " | 91 | 89 | 47 | 571 | 325 | −7% | " |
| 26 | II-1 (0.01) | X-26 | " | " | 94 | 92 | 48 | 321 | 313 | −3% | Invention |
| 27 | II-2 (0.02) | X-26 | " | " | 93 | 92 | 49 | 324 | 318 | −4% | " |
| 28 | III-2 (0.02) | X-26 | " | " | 93 | 92 | 48 | 325 | 315 | −3% | " |
| 29 | II-1 (0.01) | X-30 | " | " | 94 | 93 | 49 | 326 | 314 | −5% | " |
| 30 | II-1 (0.01) | X-37 | " | " | 92 | 91 | 50 | 322 | 311 | −5% | " |
| 31 | II-1 (0.01) | X-26 | D-5 | " | 93 | 91 | 49 | 323 | 313 | −3% | " |
| 32 | II-1 (0.01) | " | D-35 | " | 93 | 92 | 49 | 321 | 316 | −4% | " |
| 33 | II-1 (0.01) | " | D-21 | C-24 | 94 | 92 | 48 | 322 | 315 | −4% | " |
| 34 | II-1 (0.01) | " | " | C-35 | 93 | 92 | 49 | 321 | 313 | −4% | " |
| 35 | II-1 (0.01) | X-3 | " | " | 92 | 91 | 48 | 323 | 315 | −6% | " |

As is apparent from Table 4, the samples No. 19 and No. 24, containing comparative hardener H-1, are inferior in the glossiness and scratch resistance, and the samples No. 20 and No. 25, containing comparative hardener H-2, although better in the glossiness and scratch resistance than the samples containing comparative hardener H-1, take time until the degree of swelling thereof becomes settled and are poor in the progess of hardening, whereas the samples Nos. 21 through 23 and 26 through 35, all containing the hardeners of this invention, are excellent in all the layer's physical characteristics including the glossiness, scratch resistance and degree of swelling.

Further, regarding the sensitivity change with the lapse of time, where the hardeners of this invention are used, the samples Nos. 26 through 35, which contain the compounds of Formula [I], are largely improved as compared to the samples Nos. 21 through 23, which contain none of such compounds, and particularly the samples Nos. 26 through 34 are conspicuously excellent in this respect.

What is claimed is:

1. A silver halide photographic light-sensitive material comprising, a layer containing a compound represented by the following Formula (I), said layer being hardened with at least one of the compounds represented by the Formula (II) or (III), and a silver halide photographic emulsion layer containing at least one of the cyan couplers represented by the Formula (IX) or (X);

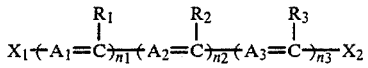

Formula (I)

wherein $R_1$, $R_2$ and $R_3$ each represents hydrogen, a halogen, a sulfonic acid group including the salts thereof, or a monovalent organic group; $A_1$, $A_2$ and $A_3$ each represents nitrogen or a

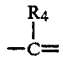

in which $R_4$ represents hydrogen, a halogen, a sulfonic acid group including the salts thereof or a monovalent organic group; $X_1$ and $X_2$ each represents a hydroxyl group or a $—NR_5R_6$ in which $R_5$ and $R_6$ each represents hydrogen, an alkyl group, an aryl group or an alkylcarbonyl group, or $R_5$ and $R_6$ may be coupled to each other to form a ring; $R_1$, $R_2$, $R_3$ and $R_4$ may also be coupled to each other to form a ring, and at least one of the groups represented by $R_1$, $R_2$, $R_3$ and $R_4$ and at least one of the groups represented by $R_5$ and $R_6$ may further be coupled to each other to form a ring; and each of $n_1$, $n_2$ and $n_3$ is an integer of from 0 to 3;

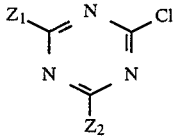

Formula (II)

wherein $Z_1$ represents chlorine, a hydroxy group, an alkyl group, an alkoxy group, an alkylthio group, a —OM group in which M represents a monovalent metal atom, or a —NR'R" group and —NHCOR'" in which R', R" and R'" each represents hydrogen, an alkyl group or an aryl group; and $Z_2$ has the same definition as $Z_1$ except it does not include chlorine;

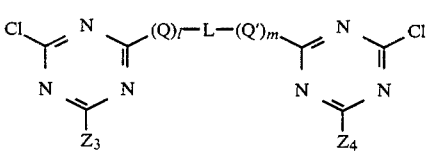

Formula (III)

wherein $Z_3$ and $Z_4$ each represents chlorine, a hydroxy group, an alkyl group, an alkoxy group or a —OM group in which M represents a monovalent metal atom; Q and Q' each represents an —O—, —S— or —NH— group; L represents an alkylene group or an arylene group; and l and m each represents 0 or 1;

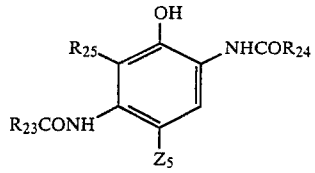

Formula (IX)

wherein $R_{23}$ represents an alkyl group or an aryl group; $R_{24}$ represents an alkyl group, a cycloalkyl group, an aryl group or a heterocyclic group; $R_{25}$ represents hydrogen, a halogen, an alkyl group or an alkoxy group, and $R_{25}$ may be coupled to $R_{23}$ to form a ring; and $Z_5$ represents hydrogen or a group capable of splitting off through a reaction thereof to the oxidation products of an aromatic primary amine color developing agent;

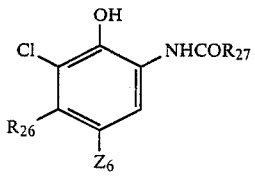

Formula (X)

wherein $R_{26}$ represents a normal or branch chained alkyl group having 1 to 4 carbon atoms; $R_{27}$ represents a ballast group; $Z_6$ has the same definition as $Z_5$.

2. The silver halide photographic light-sensitive material as claimed in claim 1, wherein said $R_{26}$ is a normal or branch chained and unsubstituted alkyl group having 2 to 4 carbon atoms.

3. The silver halide photographic light-sensitive material as claimed in claim 1, wherein said $R_{27}$ is represented by the Formula (XI);

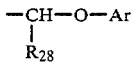

Formula (XI)

wherein $R_{28}$ represents hydrogen or an alkyl group having 1 to 18 carbon atoms; and Ar represents an aryl group.

4. The silver halide photographic light-sensitive material as claimed in claim 1, wherein said $Z_5$ and $Z_6$ represent hydrogen or chlorine.

5. The silver halide photographic light-sensitive material as claimed in claim 1, wherein said compounds represented by said Formula (I) are represented by the Formula (IV) or (V);

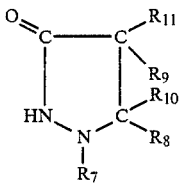

Formula (IV)

wherein $R_7$ represents hydrogen, an alkyl group or an aryl group; and $R_8$, $R_9$, $R_{10}$ and $R_{11}$ each represents hydrogen, an alkyl group, an aryl group or a hydroxyl group;

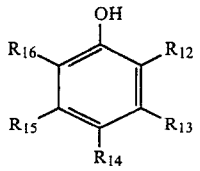

Formula (V)

wherein $R_{12}$, $R_{13}$, $R_{14}$, $R_{15}$ and $R_{16}$ each represents hydrogen, a halogen, a sulfonic acid group or a monovalent organic group, provided that at least one of said $R_{12}$, $R_{14}$ and $R_{16}$ is a hydroxyl group or $-NR_{17}R_{18}$ in which each of $R_{17}$ and $R_{18}$ has the same definition as $R_5$ and $R_6$, respectively, and said $R_{12}$, $R_{13}$, $R_{14}$, $R_{15}$ and $R_{16}$ may be coupled to each other to form a ring.

6. The silver halide photographic light-sensitive material as claimed in claim 5, wherein the compounds represented by said Formula (V) are represented by the Formula (VI);

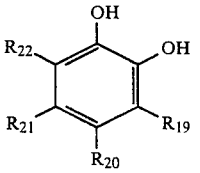

Formula (VI)

wherein $R_{19}$, $R_{20}$, $R_{21}$ and $R_{22}$ each represents hydrogen, an alkyl group, an alkoxy group, a cycloalkyl group, a cycloalkyloxy group, an aryl group, an aryloxy group, an alkylcarbonyloxy group or an alkyloxycarbonyl group; and $R_{19}$, $R_{20}$, $R_{21}$ and $R_{22}$ may be coupled to each other to form a ring.

7. The silver halide photographic light-sensitive material as claimed in claim 1, wherein the compounds represented by said Formula (I) are added in an amount of from $1.0\times10^{-4}$ to 1.0 mole per mole of silver halide used therein.

8. The silver halide photographic light-sensitive material as claimed in claim 1, wherein the compounds represented by said Formula (I) are added in an amount of from $1.2\times10^{-3}$ to $1.0\times10^{-1}$ mole per mole of silver halide used therein.

9. The silver halide photographic light-sensitive material as claimed in claim 1, wherein the compounds represented by said Formula (I) are added at any point of time from the time of preparing a silver halide emulsion to the time of coating the silver halide emulsion.

10. The silver halide photographic light-sensitive material as claimed in claim 1, wherein the compounds represented by said Formula (I) are added in at least one of (i) a layer containing a light-sensitive silver halide emulsion spectrally sensitized with the compounds represented by the Formula (VII) or (VIII) and (ii) a non-light-sensitive hydrophilic colloidal layer adjacent to said emulsion layer;

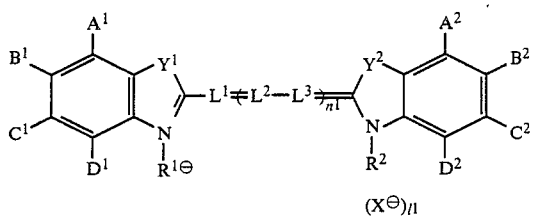

Formula (VII)

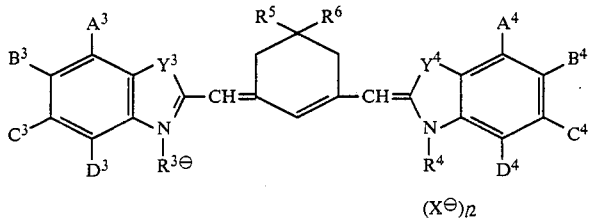

Formula (VIII)

wherein $Y^1$, $Y^2$, $Y^3$ and $Y^4$ each represents oxygen, sulphur or selenium; $A^1$, $A^2$, $A^3$, $A^4$, $B^1$, $B^2$, $B^3$, $B^4$, $C^1$, $C^2$, $C^3$, $C^4$, $D^1$, $D^2$, $D^3$ and $D^4$ each represents hydrogen, a halogen, an alkyl group, an alkoxy group, a phenyl group, a cyano group, a nitro group or an alkoxycarbonyl group; and, at least one of the combinations of $A^1$ and $B^1$, $B^1$ and $C^1$, $C^1$ and $D^1$, $A^2$ and $B^2$, $B^2$ and $C^2$, $C^2$ and $D^2$, $A^3$ and $B^3$, and $C^3$, $C^3$ and $D^3$, $A^4$ and $B^4$, $B^4$ and $C^4$, and $C^4$ and $D^4$ may be coupled to form a benzene ring; $R^1$, $R^2$, $R^3$ and $R^4$ each represents an alkyl group or an aryl group, $R^5$ and $R^6$ each represents a lower alkyl group; $L^1$, $L^2$ and $L^3$ each represents a methine group; $X^{\ominus}$ represents an acid anion; n' is an integer of 1 or 2; and $1^1$ represents an integer of 0 or 1, and $1^1$ is 0 when the compound forms an intramolecular salt.

11. The silver halide photographic light-sensitive material as claimed in claim 1, wherein the compounds represented by said Formula (I) are added in a layer containing a light-sensitive silver halide emulsion spectrally sensitized with the compounds represented by said Formula (VII) or (VIII).

12. The silver halide photographic light-sensitive material as claimed in claim 1, wherein the compounds represented by said Formula (II) or (III) are added in an amount of from 1 to 100 mg per g of gelatin used.

13. The silver halide photographic light-sensitive material as claimed in claim 1, wherein the compounds represented by said Formula (II) or (III) are added in an amount of from 5 to 50 mg per g of gelatin used.

14. The silver halide photographic light-sensitive material as claimed in claim 1, wherein said silver halide emulsion layer comprises a silver halide emulsion whose grain size is within the range of from 0.1 to 1.0μ.

15. The silver halide photographic light-sensitive material as claimed in claim 10, wherein the compounds represented by said Formula (VII) or (VIII) are added in an amount of from $1\times10^{-6}$ to $1\times10^{-4}$ mole per mole of silver halide used.

16. The silver halide photographic light-sensitive material as claimed in claim 10, wherein the compounds represented by said Formula (VII) or (VIII) are added in an amount of from $5\times10^{-6}$ to $5\times10^{-5}$ mole per mole of silver halide used.

* * * * *